US010883326B2

(12) United States Patent
Ford

(10) Patent No.: US 10,883,326 B2
(45) Date of Patent: Jan. 5, 2021

(54) HYDRAULIC ANCHORING ASSEMBLY FOR INSERTABLE PROGRESSING CAVITY PUMP

(71) Applicant: INFLATABLE PACKERS INTERNATIONAL PTY LTD, Osborne Park, Western Australia (AU)

(72) Inventor: Francis John Guillena Ford, Osborne Park (AU)

( * ) Notice: Subject to any disclaimer, the term of this patent is extended or adjusted under 35 U.S.C. 154(b) by 242 days.

(21) Appl. No.: 15/768,086

(22) PCT Filed: Oct. 14, 2016

(86) PCT No.: PCT/AU2016/050972

§ 371 (c)(1),
(2) Date: Apr. 13, 2018

(87) PCT Pub. No.: WO2017/063051

PCT Pub. Date: Apr. 20, 2017

(65) Prior Publication Data

US 2018/0305994 A1 Oct. 25, 2018

(30) Foreign Application Priority Data

Oct. 16, 2015 (AU) ..... 2015904259
Sep. 22, 2016 (AU) ..... 2016903831

(51) Int. Cl.
*E21B 23/01* (2006.01)
*E21B 43/12* (2006.01)
(Continued)

(52) U.S. Cl.
CPC ..... *E21B 23/01* (2013.01); *E21B 33/127* (2013.01); *E21B 33/1293* (2013.01);
(Continued)

(58) Field of Classification Search
CPC .. E21B 2034/007; E21B 23/01; E21B 33/127; E21B 33/1293; E21B 34/063; E21B 34/10; E21B 43/121; E21B 43/126
See application file for complete search history.

(56) References Cited

U.S. PATENT DOCUMENTS 1,892,217 A 12/1932 Moineau
2,505,136 A 4/1950 Moineau
(Continued)

FOREIGN PATENT DOCUMENTS

WO 2003001028 A1 1/2003
WO 2010036236 A1 4/2010

OTHER PUBLICATIONS

International Search Report and Written Opinion issued in PCT/AU2016/050972, dated Jan. 19, 2017; ISA/AU.

*Primary Examiner* — Caroline N Butcher
(74) *Attorney, Agent, or Firm* — Harness, Dickey & Pierce, P.L.C.

(57) ABSTRACT

A hydraulic anchoring assembly (10, 10*a*), and method of its use, for anchoring and sealing an insertable progressing cavity pump on rods in a well. The assembly (10, 10*a*) has one or more cup seals (42, 42*a*), upstream of one or more inflatable packers (14, 14*a*) upstream of one or more hydraulic slips (16). The cup seals (42, 42*a*) provide a pressure differential for inflation of the upstream most inflatable packer (14), which in turn provides a pressure differential for the downstream inflatable packer(s) (14*a*) to inflate to produce a fluid tight seal between the insertable progressing cavity pump and the well. In highly deviated wells the up seals (42, 42*a*) can be used to pump the hydraulic anchoring assembly (10, 10*a*) down the well in situations where the rods would otherwise buckle.

15 Claims, 13 Drawing Sheets

(51) Int. Cl.

| | |
|---|---|
| ***E21B 33/127*** | (2006.01) |
| ***E21B 33/129*** | (2006.01) |
| ***E21B 34/06*** | (2006.01) |
| ***E21B 34/10*** | (2006.01) |

(52) U.S. Cl.
CPC ..... *E21B 34/063* (2013.01); *E21B 34/10* (2013.01); *E21B 43/121* (2013.01); *E21B 43/126* (2013.01); *E21B 2200/06* (2020.05)

(56) References Cited

U.S. PATENT DOCUMENTS

| | | | | |
|---|---|---|---|---|
| 4,121,659 | A | 10/1978 | Taylor | |
| 4,834,175 | A * | 5/1989 | Ross | E21B 33/1295 166/120 |
| 5,103,901 | A * | 4/1992 | Greenlee | E21B 33/1295 166/120 |
| 5,778,982 | A | 7/1998 | Hauck et al. | |
| 6,557,639 | B1 * | 5/2003 | Matthews | E21B 43/121 166/105 |
| 7,552,779 | B2 | 6/2009 | Murray | |
| 7,905,294 | B2 | 3/2011 | Clark et al. | |
| 2007/0209800 | A1 * | 9/2007 | Berry | E21B 43/126 166/369 |
| 2009/0101362 | A1 | 4/2009 | Loughlin | |
| 2011/0127030 | A1 * | 6/2011 | Clark | E21B 23/01 166/212 |
| 2012/0160523 | A1 * | 6/2012 | Burgos | E21B 33/129 166/387 |
| 2014/0238689 | A1 * | 8/2014 | Hughes | E21B 33/1291 166/377 |
| 2015/0259998 | A1 * | 9/2015 | Moore | E21B 23/01 166/382 |

* cited by examiner

Installation

Inflation & Blow Out

Retrieval

HYDRAULIC ANCHORING ASSEMBLY FOR INSERTABLE PROGRESSING CAVITY PUMP

CROSS-REFERENCE TO RELATED APPLICATIONS

This application is a 371 U.S. National Stage of International Application No. PCT/AU2016/050972, filed Oct. 14, 2016. This application claims the benefit of Australian Patent Applications Nos. 2015904259, filed Oct. 16, 2015 and 2016903831, filed Sep. 22, 2016. The entire disclosures of the above applications are incorporated herein by reference.

FIELD OF THE INVENTION

The present invention relates to a hydraulic anchoring assembly for insertable progressing cavity pump (I PCP).

More particularly, the present invention relates to a hydraulic anchoring assembly for anchoring and sealing an I-PCP without the use of a pump seating nipple (PSN).

Further, the present invention relates to a hydraulic anchoring assembly for I-PCP's which provides sealing with one or more inflatable packers, instead of a mechanical packer, and which assembly provides anchoring with hydraulic slip, instead of a mechanical slip.

Further, the present invention relates to a hydraulic anchoring assembly that uses a fluid restriction (typically in the form of one or more cup seals) located upstream of the or all of the inflatable packers, to provide a pressure differential sufficient to cause inflation of the or each inflatable packers.

Further, the present invention relates to a hydraulic anchoring assembly for deploying I-PCP's on sucker rods but with the provision of hydraulic pump down assistance to achieve deployment in situations where sucker rods would normally buckle.

Terminology

In the fields of well and borehole technology there are a diversity of terminologies used. So as to avoid confusion the following specific terminology is used in the context of the present invention:

- "annular space", in relation to the well bore, refers to the annular space between the tool and the well bore;
- "borehole" refers to a hole bored or drilled in a formation, and is sometimes referred to as a well bore;
- "casing" refers to relatively large diameter pipes threaded end to end and inserted into a borehole and are typically held in place with cementitious material;
- "deflate" refers to deflation of an inflatable element of an inflatable packer, and is the opposite of inflation;
- "downhole" refers to the a hole drilled or bored in the earth, especially a borehole, and is often used to refer to any direction or orientation other than downward, such as, including vertically upwards. Also, "downhole equipment" is used to denote any piece of equipment used in the well itself;
- "downstream" is defined with reference to the direction of insertion of the hydraulic anchoring assembly of the present invention into the well and is not defined in relation to the flow of production fluids out of the well. Hence, downstream means further into the well, with respect the surface of the well. Downstream is the opposite of upstream;

- "drill rods" refers to long hollow drill rods used in drilling boreholes/wells, and are sometimes referred to as "rods", also referred to as "tubing" in the oil and gas industry, and includes "coiled tubing";
- "drilling fluid" refers to any type of slurry or liquid capable of use in drilling a well;
- "hydraulic slip" refers to hydraulically powered slip;
- "inflatable packer" refers to a down hole device capable of inflation with inflation fluid for temporarily or permanently blocking off the annular space within a well (often abbreviated to packer);
- "inflate" (and "inflation") refers to inflation of an inflatable element of an inflatable packer;
- "inflation fluid" refers to non-settable fluids used to inflate the packers and/or to change the mode of operation of the tool. Inflation fluid typically includes liquids such as water and brine and the like. Inflation fluid may be gases, such as nitrogen;
- "inflation lines" refers to a flexible hydraulic tube used to connect inflation fluid (which may include gases) under pressure to the hydraulic anchoring assembly of the present invention or packer to permit control of the operation of the tool and inflation of the packer (also referred to as inflation tubes or tubing and control lines or tubing);
- "I-PCP" refers to a insertable PCP;
- "lower" has the same meaning as downstream;
- "mechanical slip" refers to mechanically powered slip;
- "multi-set" in the context of packers refers to packers that are set (such as by inflation) more than once and are then moved or removed in order to be set again, this process being repeatable many times over the operational life of the packer;
- "PCP" is an abbreviation for progressing cavity pump;
- "pressure" refers to differential pressure across one or more components and, unless otherwise specifically stated, any reference to pressure refers to differential pressure rather than absolute pressure;
- "progressing cavity pump" refers to a type of positive displacement pump, also sometimes referred to as a progressing cavity pump, progg cavity pump, eccentric screw pump, cavity pump, Moineau pump, mono pump or mohno pump and is used in well drilling;
- "pump seating nipple" ("PSN") refers to a downhole constriction located within tubing for landing of a pump;
- "running in" or "run-in" refers to the operation of inserting a tool and/or drill rods and the like into a well bore;
- "single-set" in the context of packers refers to packers that are set (such as by inflation) once only and are not intended to be removed once set;
- "slip" refers to a type of wedge used to transform a longitudinal force applied to drawing the rods out of the hole into a transverse force exerted outwardly into the casing, in this way slips act as anchors. The wedge slips against a sleeve to deliver outward force to expand at least a part of the sleeve. This may sometimes referred to as an expansion wedge. Slips are commonly used in mechanical slip packers and liner hangers;
- "upper" has the same meaning as upstream;
- "upstream" is defined with reference to the direction of insertion of the hydraulic anchoring assembly of the present invention into the well and is not defined in relation to the flow of production fluids out of the well. Hence, upstream means closer to the surface of the well. Upstream is the opposite of downstream;

"well annulus" refers to the annular space between the tool and the casing;

"well" refers to a hole bored in the ground. The term well is used interchangeably with bore, well bore and borehole; and, "well fluid" refers to a combination of gas, oil, water and suspended solids, that comes out of and/or are used in a well.

In the context of the present invention the term "above" has the same meaning as "upstream of", since in some uses the PCP may be in a horizontal well. And "below" has the opposite meaning of "above".

BACKGROUND TO THE INVENTION

For many years wells have used down hole pumps to help lift well fluids to the surface. One such pump is the so called progressing cavity pump (PCP). PCP systems derive their name from the positive displacement pump that evolved from the helical gear pump concept first developed by Rene Moineau in the late 1920's (typified by U.S. Pat. Nos. 1,892,217 and 2,505,136). Although, these pumps are now most commonly referred to as progressing cavity pumps, they also are called screw pumps or Moineau pumps. They are increasingly used for artificial lift, and have been adapted to a range of challenging lift situations (e.g. heavy oil, high sand production, and gassy wells, directional or horizontal wells).

To achieve pumping PCPs have a stator and a rotor. The stator is assembled in-line with a production tubing string which is tied back to the well head. The tubing prevents the stator from spinning. The rotor is installed separately into the stator and is driven by sucker rods, run inside the production tubing. A landing sub is typically employed to ensure the rotor has seated correctly within the stator. The zone above and below the PCP must not have communication in order to generate the differential pressure required to lift the well fluid to surface.

When a PCP stator is damaged, the production tubing, which it is a part of, must be removed in order to repair or replace the stator. The expense and logistics required for this operation have led to the development of an alternative method of installation as a contingency to be used when the main PCP fails. This is known as an Insertable PCP or I-PCP (exemplified by U.S. Pat. No. 7,905,294). This is a design whereby the stator and the rotor are coupled together and run in the well together using the sucker rods.

A PCP can be refurbished with an I-PCP. The original rotor string of the PCP must first be removed in order for the new I-PCP to be installed inside the production tubing. The original stator is no longer used for pumping and simply becomes a part of the production tubing string. For the I-PCP to function, it requires an anchor to prevent the stator from rotating when drive is transmitted from the sucker rods to the rotor, and a seal to permit the well fluids to be pumped to the surface. This is usually achieved by way of a pump seating nipple (PSN), which is available in various profiles. An I-PCP offers cost advantages compared to traditional repair/replacement of the original PCP stator, and mitigate the need to remove the original production tubing, which otherwise results in large costs to the well operators.

However, one challenge of installing an I-PCP is anchoring the stator to the well casing with the PSN, which is prone to corrosion and internal profile/surface damage which compromises its ability to seal. Another disadvantage is that a PSN cannot be retrofitted to existing wells. This means only wells with a PSN already installed in the production tubing can take advantage of the benefits offered by an I-PCP. It is also for this reason that the PSN is prone to damage as it is exposed to the well bore environment for long durations before it is actually required for use—when the main PCP is damaged and an I-PCP is installed in its place. Which means when the PSN is required for the deployment of an I-PCP, it may no longer be in a condition suitable for use There is a further issue that the location of the landing zone for the PSN may be in the wrong place as information gathered over the life of the well suggest that a different pump location is required for the further operation of the well. Another challenge faced when landing the I-PCP into a PSN, is that it normally requires a certain amount of force to land the I-PCP into the PSN. There are situations where the PSN has been installed at great depths and/or in a horizontal section of the well, whereby the sucker rods lack the compressive strength to transmit the necessary force required to land the I-PCP into the PSN. Each of these issues requires removal of the production tubing to reposition and/or replace the PSN, which counter acts the benefits offered by installing an I-PCP.

This latter issue has been overcome in part by a mechanical anchor, which allows insertable PCP's (I-PCP's) to be inserted and anchored into the production tubing without the need for a PSN. The I-PCP together with this mechanical anchor does not require a PSN for its location within the well. Instead the mechanical I-PCP anchor uses a mechanical slip and a mechanical packer which prevent rotation of the pump, providing a seal between the pump intake and high pressure discharge, and prevent longitudinal movement of the pump caused by pressure differential across the anchor seal. The problem of the mechanical I-PCP anchor is that it requires axial forces to set, which means it requires a drag assembly to provide the necessary resistance to initiate the setting procedure. This method increases the risk of premature deployment. This method of setting also makes it difficult or sometimes impossible to set the anchor in highly deviated or deep wells, whereby the load required to set cannot be transmitted through the sucker rods it is deployed on. Further, the mechanical I-PCP anchor seal is prone to leakage given its limited seal expansion and limited effective length of contact with the production tubing. Also, the mechanical I-PCP anchor has a limited ability to comply to the tubing profile, as stresses acting on the tubing can cause it to go out of round, inability to comply to tubing ID tolerances, or inability to seal on surfaces which are pitted, scored or corroded.

An issue with the mechanical I-PCP anchor is that it requires manipulation of the drill rods in order to change modes of operation. This requires the provision of a valve control typically in the form of a so-called J-latch. The disadvantage of using a J-latch is that in deep and deviated wells it can be difficult for the operator to determine how much downward or upward force to apply to the drill rods to move the J-latch to the next operational position. This lack of "feel" can result in the operator dragging or pushing the mechanical anchor inside the casing and thereby damaging the casing and producing wear in the mechanical anchor and reducing the life of the anchor or resulting in a poorly set anchor and seal, which compromises function of the I-PCP and reduces the rate well fluid can be pumped from the well.

A further limitation of Mechanical I-PCP anchor is that they cannot seal into an unlined open hole well. Instead an I-PCP must be sealed to casing or tubular due to their limited expansion and compliance.

PCPs and I-PCPs are single set type down hole devices, usually installed and run for the life of the well or the life of the pump, then removed and replaced—if needed.

The anchoring assembly of the present invention overcomes some or all of these limitations by using a hydraulic slip for gripping the well and an inflatable packer for providing a seal between the pump and the well. In this context the well may be lined or open hole. Also, in the context of the anchoring assembly of the present invention the well is also taken to mean a tubular located within the well.

Difference Between Mechanical and Inflatable Packers

It is important to note that there are considerable differences between mechanical and inflatable packers and they are not equivalents of each other. Superficially both have an elastomeric sleeve that is caused to expand upon a mandrel to seal against the inner curved surface of a tubular. However, mechanical packers rely upon longitudinal compression to achieve radial expansion, whereas inflatable packers rely upon inflation via high pressure well fluids to increase the radial dimension of the elastomeric sleeve which results in shortening of the length of the sleeve. Mechanical packers typically require rotation to shorten the length of the sleeve and expand the packer. In highly deviated wells there is considerable friction between the well bore and the drill string, which results in unpredictability in the number of turns of the drill string needed to expand a mechanical packer. Also, in such wells rotation of the drill string can lead to part of the drill string above the PCP or I-PCP unthreading and dropping the PCP/I-PCP down the well and necessitating costly retrieval processes (referred to as "fishing").

SUMMARY OF THE INVENTION

Therefore, it is an object of the present invention to provide a hydraulic anchoring assembly for an insertable progressing cavity pump, the anchoring assembly including a hydraulic slip and an inflatable packer.

In accordance with one aspect of the present invention, there is provided a hydraulic anchoring assembly for anchoring and sealing an insertable progressing cavity pump on rods in a well, the anchoring assembly comprising:

an inner mandrel having a longitudinal bore therethrough connected downstream of and in fluidic communication with the insertable progressing cavity pump;

an inflatable packer connected to the mandrel by shearable means, the inflatable packer being inflated by increasing pressure of fluids within the inner mandrel above an inflate pressure to seal the inner mandrel to the well;

a one-way inflation valve in fluidic communication with the inflatable packer to maintain inflation of the inflatable packer;

a hydraulic slip means connected to the inner mandrel by shearable means, the hydraulic slip being activated by further increasing pressure of fluids within the inner mandrel above a slip deployment pressure for gripping the well to resist longitudinal and rotational movement of the inner mandrel in the well;

a one-way deployment valve in fluidic communication with the hydraulic slip to maintain deployment of the hydraulic slip; and a sealing means for sealing the inner mandrel downstream of the hydraulic slip means, the sealing means being releasable to allow fluid to flow through the inner mandrel to the insertable progressing cavity pump;

wherein the inflate pressure is below the slip deployment pressure.

Typically, the anchoring assembly also comprises a restriction means, conveniently in the form of one or more cup seals, to provide a pressure differential for inflation of the inflatable packer. The cup seals assist the sucker rod string to deploy the I-PCP down the well at a pump down pressure which is below the pressure at which the packer(s) inflates. The cup seals thereby permit the anchoring assembly to be forced down the well in situations where sucker rods would normally buckle.

Typically, the anchoring assembly also comprises a premature inflation sleeve to prevent inflation of the inflatable packer during run in via pressurising the annulus upstream of the cup seal.

Typically, the anchoring assembly also comprises release means for releasing pressure from and deflating the inflatable packer and releasing the hydraulic slip means for releasing the anchoring assembly from engagement with the well.

Typically, the sealing means is in the form of a blowout plug attached to the downstream end of the inner mandrel via a shear pin.

Alternatively, the sealing means could be in the form of a dissolvable blowout plug, obviating the need for a shear pin. Typically, the dissolvable blowout plug is a metal which dissolves by galvanic reaction with water or other liquids in the well.

Typically, the anchoring assembly also comprises a shearable means in operative association with the inflatable packer such that pull up on the rods deflates the inflatable packer.

Typically, the anchoring assembly also comprises a shearable means in operative association with the hydraulic slip means such that further pull up on the rods releases the hydraulic slip means and allows the anchoring assembly to be removed from the well.

It is important, for the operation of the I-PCP, that the inner mandrel be prevented from moving relative to the inflatable packer during normal operation. This is achieved with anti-rotation couplings, typically using castellations. The inner mandrel is only able to move with respect to the inflatable packer by pulling up on the rods by which operation the inflatable packer is caused to deflate for removal of the anchoring assembly from the well.

Also, it is important, that the inner mandrel be prevented from moving relative to the hydraulic slip means during normal operation. The inner mandrel is only able to move relative to the hydraulic slip means by further pulling up on the rods, after deflation of the inflatable packer, by which pulling the hydraulic slip means is caused to release from the wall. That is, the hydraulic slip means is only able to release from engagement with the production string after the inflatable packer has deflated.

Optionally, the anchoring assembly may have multiple inflatable packers. The use of two inflatable packers becomes important where well conditions do not permit full inflation of a single inflatable packer. For example, were a cup seal is used proximate the upstream end of the anchoring assembly, there may be insufficient pressure differential to achieve full inflation of the inflatable packer, due to damage of the cup seal during run-in of the anchoring assembly. To avoid such situations a second inflatable packer, located downstream of the first mentioned inflatable packer, is provided and can achieve full inflation because of the pressure differential created by the partially inflated packer located upstream of it.

Optionally, the anchoring assembly may have multiple hydraulic slip means for providing additional grip onto the production tubing to inhibit both rotation and longitudinal movement of the I-PCP with respect to the production tubing.

In accordance with another aspect of the present invention, there is provided a method for anchoring and sealing an insertable progressing cavity pump on rods in a well with a hydraulic anchoring assembly comprising an inflatable packer and a hydraulic slip means, the method including the steps of:

connecting the hydraulic anchoring assembly downstream of the insertable progressing cavity pump;

running the hydraulic anchoring assembly into the well to a location where the insertable progressing cavity pump is to be operated;

increasing the pressure of fluids in the hydraulic anchoring assembly above a first inflate pressure to inflate the inflatable packer to seal the insertable progressing cavity pump to the well;

further increasing the pressure of fluids in the hydraulic anchoring assembly above a second pressure to activate the hydraulic slip means for gripping the well to resist longitudinal and rotational movement of the insertable progressing cavity pump in the well; and releasing a sealing means for allowing fluid to flow through the hydraulic anchoring means to the insertable progressing cavity pump;

wherein the first pressure is below the second pressure.

Typically, the method also includes the step of installation via a run-in pressurise above the cup seal to hydraulically force the anchoring assembly down the well where rods are buckled and cannot push, the run-in pressure being less than the first inflate pressure.

Typically, the method includes run-in of the anchoring assembly via pushing down on rods attached upstream of the anchoring assembly.

Typically, the method includes releasing the sealing means by increasing the pressure of fluids in the anchoring assembly above a third pressure, the third pressure being greater than the second pressure.

Typically, the method includes releasing the sealing means by dissolving a plug sealing means.

Typically, the method includes releasing the sealing means by dissolving a ball sealing means.

Typically, the method includes maintain the inner mandrel stationary with respect to the inflatable packer during normal operation and only allowing relative movement during deflation of the inflatable packers.

Typically, the method includes maintaining the inner mandrel stationary with respect to the hydraulic slip means during normal operation and only allowing relative movement during release of the hydraulic slip means from the well.

Typically, the method includes pull up on the rods to deflate the inflatable packer.

Typically, the method includes further pull up on the rods to release the hydraulic slip means and allow the anchoring assembly to be removed from the well.

The hydraulic anchoring assembly of the present invention is also referred to an anchoring assembly. Also, whilst it is referred to primarily with reference to anchoring, sealing is also critical to its function. That is, references to anchoring typically include sealing unless stated otherwise.

In the context of the present invention all pressures are referred to as pressure differentials rather than absolute pressures, unless stated otherwise.

Throughout the specification, unless the context requires otherwise, the word "comprise" or variations such as "comprises" or "comprising", will be understood to imply the inclusion of a stated integer or group of integers but not the exclusion of any other integer or group of integers. Likewise the word "preferably" or variations such as "preferred", will be understood to imply that a stated integer or group of integers is desirable but not essential to the working of the invention.

BRIEF DESCRIPTION OF THE DRAWINGS

The nature of the invention will be better understood from the following description of two specific embodiments of the hydraulic anchoring assembly for insertable progressing cavity pump of the present invention, given by way of example only, with reference to the accompanying drawings in which.

DETAILED DESCRIPTION OF PREFERRED EMBODIMENTS

Figure 1:
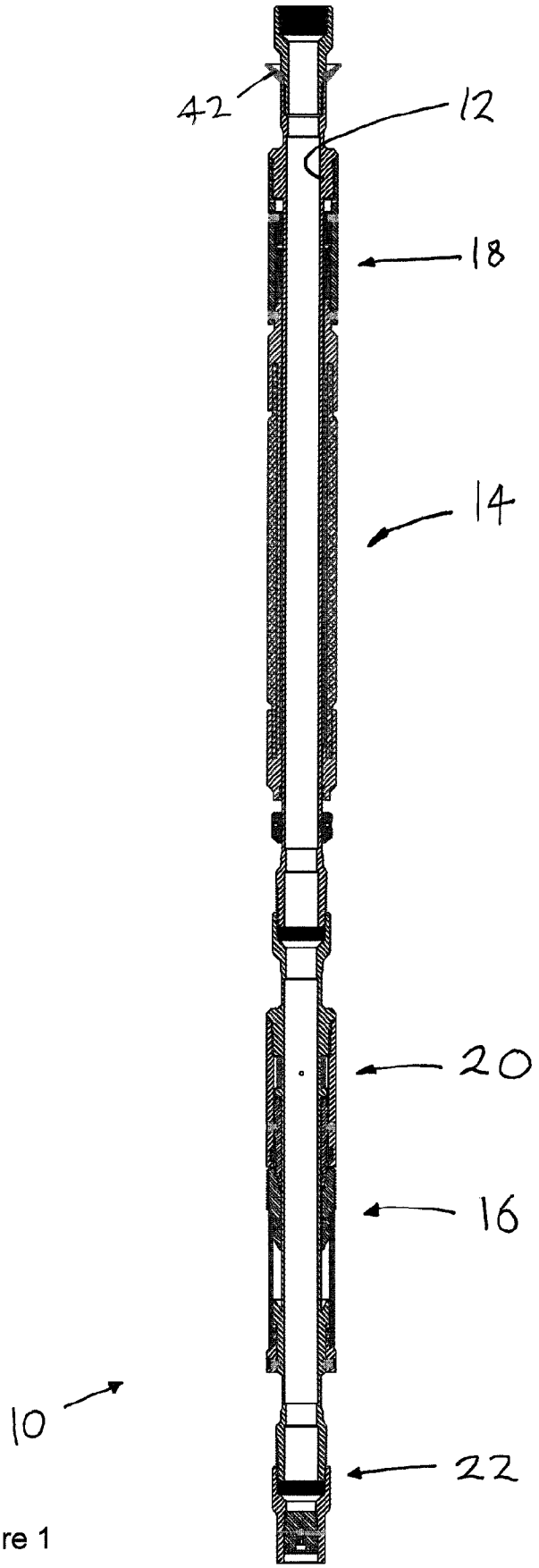
FIG. 1 is a cross-sectional side view, seen from above, of a hydraulic anchoring assembly for an I-PCP in accordance with one embodiment of the present invention.

In the drawings there is shown two embodiments of the hydraulic anchoring assembly for insertable progressing cavity pump of the present invention. The first embodiment, shown in FIGS. 1 to 6*b*, has a single restriction, in the form of a cup seal, and a single inflatable packer, whereas the second embodiment, shown in FIGS. 7*a* to 9*i*, has two or more restrictions and two or more inflatable packers.

The second is substantially the same as the first embodiment and like numerals denote like parts. In the second embodiment the letter "a" has been added to components where there is a difference to be described. For example, the first embodiment of the hydraulic anchoring assembly of the present invention is referenced as 10 and the second embodiment as 10*a*.

First Embodiment

As shown in FIG. 1 the hydraulic anchoring assembly 10 of the present invention comprises an inner mandrel 12, an inflatable packer 14 and a hydraulic slip 16 both set upon the inner mandrel, a one-way valve 18 in fluidic communication with the inflatable packer 14, a one-way deployment valve 20 in fluidic communication with the hydraulic slip 16, a sealing means 22, and a release means 24 for deflating the inflatable packer 14 and releasing the hydraulic slip 16. The hydraulic anchoring assembly 10 is intended for deployment with an I-PCP in a well (not shown) for pumping well fluids out of the well to the surface of the well.

The I-PCP has a rotor and a stator (not shown). The rotor is attached to and driven by sucker rods (not shown) and the stator is attached to the inner mandrel 12 at the upstream end of the hydraulic anchoring assembly 10. Prior to deployment the stator the I-PCP is attached to the inner mandrel 12 of the hydraulic anchoring assembly 10 and the pair are run into the well with the sucker rods, typically inside the casing of the well or other tubulars within the casing.

More particularly, the inner mandrel 12 is connected downstream of the I-PCP. The inflatable packer 14 is connected to the inner mandrel 12 by shearable means (conveniently in the form of shear pins), the inflatable packer 14 being inflated by increasing pressure of fluids within the inner mandrel 12 above a predetermined pressure, in the context of the present invention referred to as the "inflate pressure" to seal the inner mandrel 12 (and hence the I-PCP) to the well. The inflate pressure is the pressure required to overcome the one-way valve 18 and cause the inflatable packer 14 to inflate. The one-way valve 18 is in fluidic communication with the inflatable packer 14 to maintain inflation of the inflatable packer 14. The hydraulic slip 16 is connected to the inner mandrel 12 by shearable means (conveniently in the form of shear pins), the hydraulic slip 16 being is activated by further increasing pressure of fluids within the inner mandrel 12 above a slip deployment pressure for gripping the well to resist longitudinal and rotational movement of the inner mandrel 12 (and hence the stator of the I-PCP) in the well. The other one-way valve 20 is in fluidic communication with the hydraulic slip 16 to maintain grip of the inflatable slip 16 within the well. The sealing means 22, conveniently in the form of a blow-out plug, seals the inner mandrel 12 downstream of the hydraulic slip 16 to prevent flow of well fluid through the inner mandrel 12 during run-in of the hydraulic anchoring assembly 10, the sealing means 22 sealing for pressures below an inflation pressure at which the inflatable packer 14 inflates. The sealing means 22 permits inflation of the inflatable packer 14 for pressures above the inflate pressure, the sealing means 22 permits further increases in pressure of the well fluid in the inner mandrel 12 above a pressure at which the hydraulic slip 16 deploys and engages with and "grab" the well. In the context of the present invention this pressure is referred to as the "slip deployment pressure". The slip deployment pressure is the pressure required to overcome the one-way valve 20 cause the hydraulic slip 16 to deploy and grip the well. The hydraulic anchoring assembly 10 remains in this mode of operation for most of its operational life and the I-PCP stator is held stationary with respect to the well so the rotor can operate to pump well fluid to the surface of the well. The release means 24, conveniently in the form of shear pins, releases pressure from and deflates the inflatable packer 14 and releases the hydraulic slip 16 for releasing the hydraulic anchoring assembly 10 for disengagement from the well when it is desired to remove the I-PCP from the well.

More particularly, as shown in FIGS. 2*a* to 2*d*, the inner mandrel 12 is an assembly comprising components threaded and/or welded together with the inflatable packer 14 and the hydraulic slip 16 located upon it. Accordingly, the hydraulic anchoring assembly 10 is not a serviceable device but is intended for single shot and single retrieval operation.

The inner mandrel 12 conveniently consists of an upper mandrel 30 and a lower mandrel 32 threaded together. The upper mandrel 30 comprises a top cross-over 40 threadable to the stator of the I-PCP, a cup seal 42 oriented for inhibiting flow of well fluids down the well in the annular region around the hydraulic anchoring assembly and the well or tubulars, a upper mandrel cross-over 44, an upper mandrel pipe 46 extending though the inflatable packer 14, and a lower cross-over 48. Conveniently the upper mandrel cross-over 44 is threadably connected to the top cross-over 40, at its upstream end, and welded to the upper mandrel pipe 46, at its downstream end. The cup seal 42 is conveniently sandwiched between the top cross-over 40 and the upper mandrel cross-over 44. The upper mandrel 46 includes ports 50 for communication with the inflatable packer 14 via the one-way valve 18.

The upper mandrel 46 also includes an annular groove 52 located on its external curved surface proximate the lower cross-over 48. The annular groove 52 provides attachment for a stop collar 60 oriented to inhibit downstream motion of the inflatable packer 14, as described in more detail hereinafter. The stop collar 60 conveniently includes one or more grub screws 62 for securing the stop collar 60 to the annular groove 52.

The lower mandrel 32 comprises a lower mandrel cross-over 74, a lower mandrel pipe 76, and a lower cross-over 78. Conveniently the lower mandrel cross-over 74 is threaded to the lower cross-over 48 of the upper mandrel 30, at its upstream end, and welded to the lower mandrel pipe 76, at its downstream end. The lower mandrel includes ports 80 for communication with the hydraulic slip 16 via the one-way valve 20.

Figure 2A:
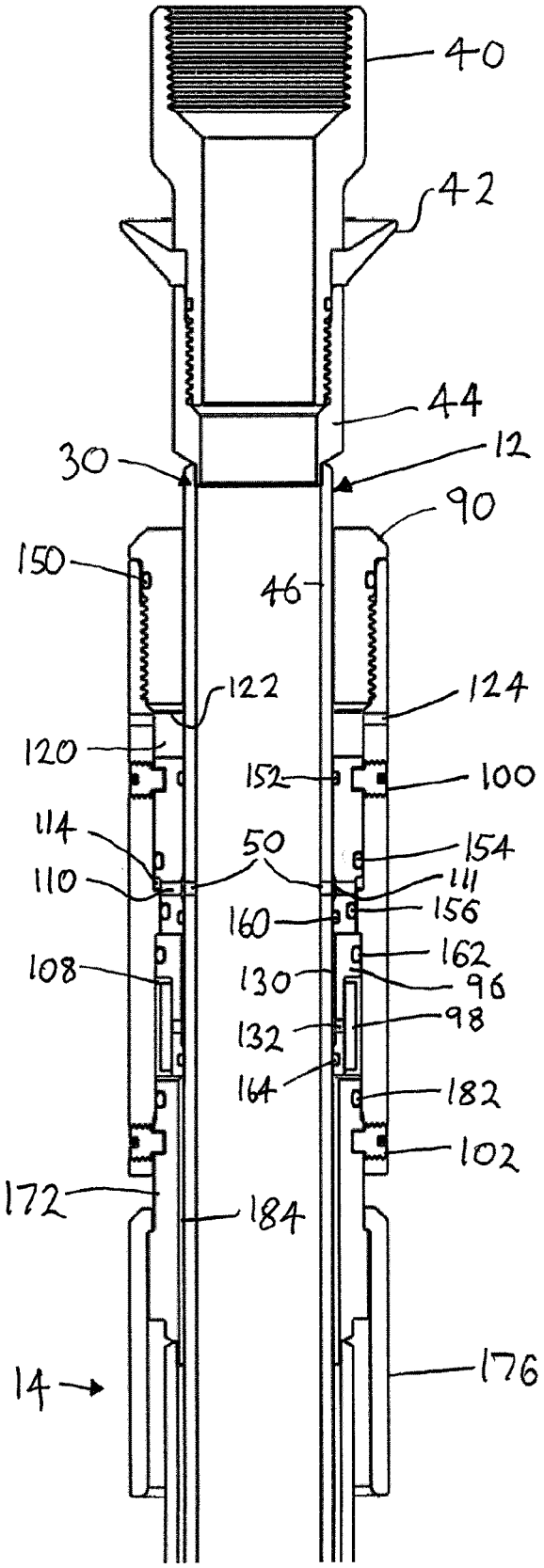
FIG. 2*a* is a cross-sectional side view of an upper portion of the hydraulic anchoring assembly of FIG. 1.
Figure 4:
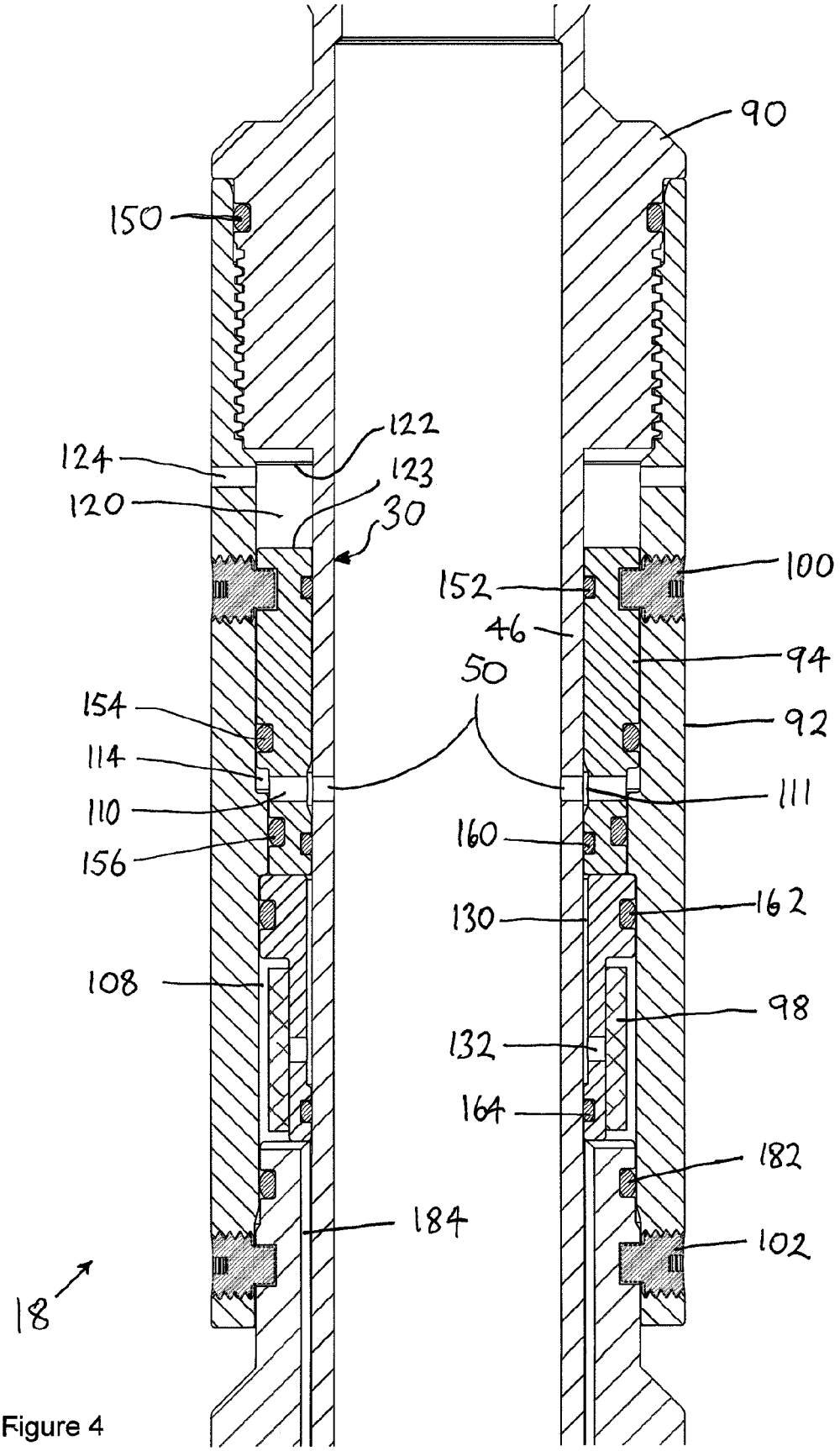
FIG. 4 is a cross-sectional side view of a one-way inflation valve of the hydraulic anchoring assembly of FIG. 1.

Particularly as shown in FIGS. 2*a* and 4, the one-way inflation valve 18 comprises a top sub 90, an inflation housing 92, a premature inflation sleeve 94, a band check valve seat 96, a band check valve 98, at least one inflation shear pin 100 and at least one deflation shear pin 102.

The top sub 90 is generally cylindrical in shape and is conveniently welded at its upstream end to the external curved surface of the upper mandrel 30. The top sub 90 has an external thread onto which is threaded the inflation housing 92. The inflation housing 92 is generally cylindrical with its lower extent open for providing an annular space with respect to the upper mandrel 30 into which the inflatable packer 14 is inserted and fixed with the shear pins 102.

The inflation housing 92 defines an inflation chamber 108 with respect to the external curved surface of the upper mandrel 30. The inflation chamber 108 houses the premature inflation sleeve 94, the band check valve seat 94 and the band check valve 98, in that order from adjacent the top sub 90 to proximate the inflatable packer 14.

Figure 3A:
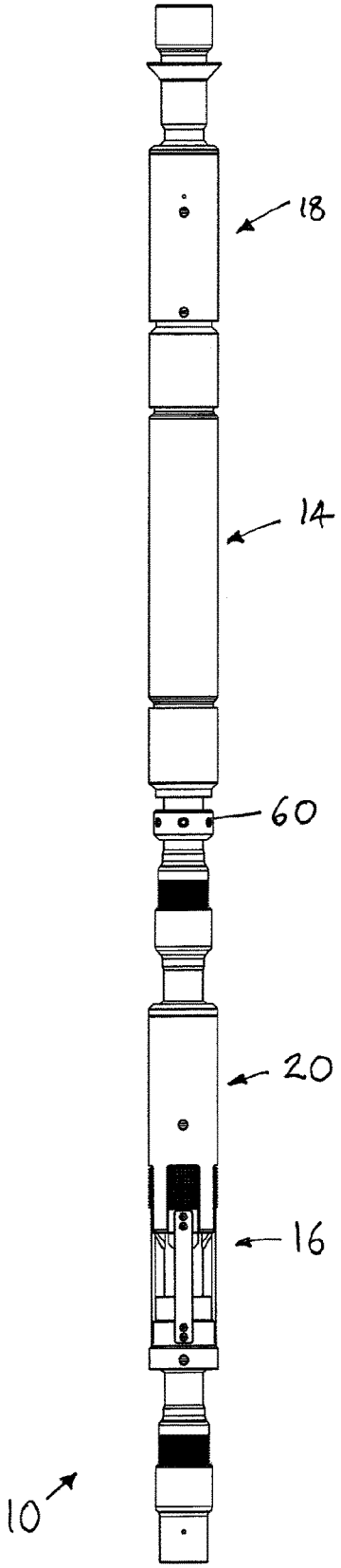
FIG. 3*a* is a side view of the hydraulic anchoring assembly of FIG. 1, shown in an installation mode of operation.

The inflation sleeve 94 is generally cylindrical and has at least one inflation port 110 terminating in an annular groove 111 located on its internal curved surface intermediate its length and oriented to overly the ports 50 of the upper mandrel 30 for communicating well fluid from the inner mandrel 12 into the one-way inflation valve 18, when the hydraulic anchoring assembly 10 is in an installation mode of operation—shown in FIG. 3*a*. The inflation housing 92 and the premature inflation sleeve 94 each have shoulders 112 and 114, respectively, oriented to cooperate to form an annular inflation cavity 114 aligned with the inflation ports 110. The inflation housing 92 is attached to the premature inflation sleeve 94 via the one or more shear pins 100. In the installation mode of operation there is an annular exhaust cavity 120 defined between the external curved surface of the upper mandrel 30, a downstream shoulder 122 of the top sub 90, the inner curved surface of the inflation housing 92 and an upstream end 123 of the premature inflation sleeve 94. The exhaust cavity 120 overlays a plurality of exhaust ports 124.

Typically, the shear pins 100 are configured to shear when the premature inflation sleeve 94 is subjected to an upstream shear force in excess of a few tonnes. The shear force is created by application of the pressure in the well fluid in the inner mandrel 12 applied to the difference in surface area of the premature inflation sleeve 94 at the upstream and downstream shoulders of the annular inflation cavity 114. The upstream shoulder of the cavity 114 is part of the premature inflation sleeve 94 whereas the downstream shoulder of the cavity 114 is part of the inflation housing 92. Hence, there is more upstream directed force on the premature inflation sleeve 94 from the cavity 114 than downstream directed force. The difference in these forces is resisted by the shear pins 100, which experience this force as shear. When the pressure in the cavity 114 exceeds a predetermined pressure the shear pins 100 shear and the momentum of the premature inflation sleeve 94 is sufficient to drive the sleeve 94 upstream with respect to the upper mandrel 30 to force the well fluid out of the annular exhaust cavity 120 out of the exhaust parts 124 and close off the cavity 120. The movement of the sleeve 94 opens the ports 50 to the band check valve seat 96 which has one or more passageways 130 leading to a corresponding number of inflation ports 132 for delivery the well fluid to the band check valve 98. When the pressure of the well fluid exceeds the resistance of the band check valve 98 the well fluid passes around the band check valve 98 and into the inflatable packer 14.

The one-way inflation valve 18 typically includes a rubber banded check valve also commonly referred to as a TAM valve, and includes a rubber collar or band intended to be located over a series of holes or ports. The effect of the rubber collar is to allow flow of well fluid in one direction through the ports but not the opposite direction.

In the present embodiment the band check valve seat 96 and the band check valve 98 in combination are the minimum components required to form the one-way valve 18. The band check valve 98 is made from elastomeric material such as rubber or synthetic rubber and may include reinforcement, as in know in the art, for changing the pressure at which the band check valve 98 allows well fluid to flow through the ports 50 from the upper mandrel 30 into the inflation chamber 108.

The premature inflation sleeve 94 and the shear pins 100 are further components of the one-way valve 18 used as an alternative configuration in the circumstances where pressure above the cup seal 42 is used to push the I-PCP and the anchor assembly 10 down the well, as opposed to using the rods to push the I-PCP and anchor assembly 10 down the well. In the former situation there is a risk that the pressure experienced by the band check valve 98, during pump down of the I-PCP, could be sufficient to cause premature inflation of the inflatable packer 14 before the I-PCP reaches its operational depth in the well. That is, without the premature inflation sleeve 94, pump down of the I-PCP with well fluid pressure exerted upon the cup seal 42 could cause the inflatable packer 14 to prematurely inflate. However, driving the I-PCP down with the rods does not risk premature inflation of the inflatable packer 14 and so the premature inflation sleeve 94 and shear pins 100 are not required.

In the context of the present invention the one-way valve 18 is intended to open for pressures (that is pressure differentials) in excess of about 700 psi (about 4.8 MPa). In such an arrangement the likely pump down pressure is in excess of about 500 psi (about 3.5 MPa). A pressure margin of about 200 psi (about 1.4 MPa) is typically used in such operations.

In the context of the present invention the shear pins 100 and 102 constitute the shearable means by which the inner mandrel 12 is attached to the inflatable packer 14. There are no other connections between the inflatable packer 14 and the inner mandrel 12.

Typically, the shear pins 100 and 102 are made from brass and their quantity and diameter is chosen to achieve the desired predetermined shear pressure.

The predetermined pressure at which the pins 100 shear is referred to as both as the shear pressure and in the context of the present invention as the "inflate pressure"—since it is the pressure at which the inflatable packer 14 begins to inflate, as described hereinafter.

In this regard the inflatable packer 14 is behaving as a seal packer to seal the hydraulic anchoring assembly 10 to the well (or tubular). Since the packer is of the inflatable type, as compared to a mechanical or swellable type, the amount of expansion and degree of conformity to the surrounding well or open hole cavity is very high and thus the risk of leakage around the packer is low. Consequently the operation of the I-PCP is much better than is possible with an anchor based upon a mechanical packer which has low expansion and low conformity to the surrounding well or open hole cavity.

The one-way inflation valve 18 includes O-ring seals 150 to 164 to effect the correct operation of the cavities 114 and 120, ports 50,110 and 132, and passageway 130. Typically, the O-ring seals are made from rubber, although they could be made from other elastomeric sealing materials, such as, for example, Nitrile.

Figure 2B:
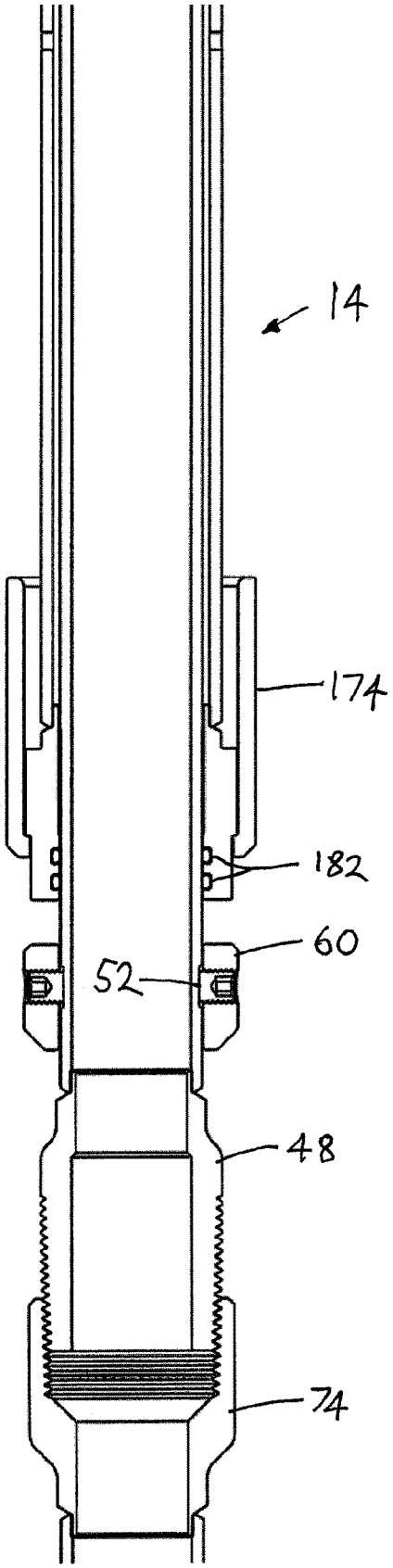
FIG. 2*b* is a cross-sectional side view of a middle portion of the hydraulic anchoring assembly of FIG. 1.
Figure 5:
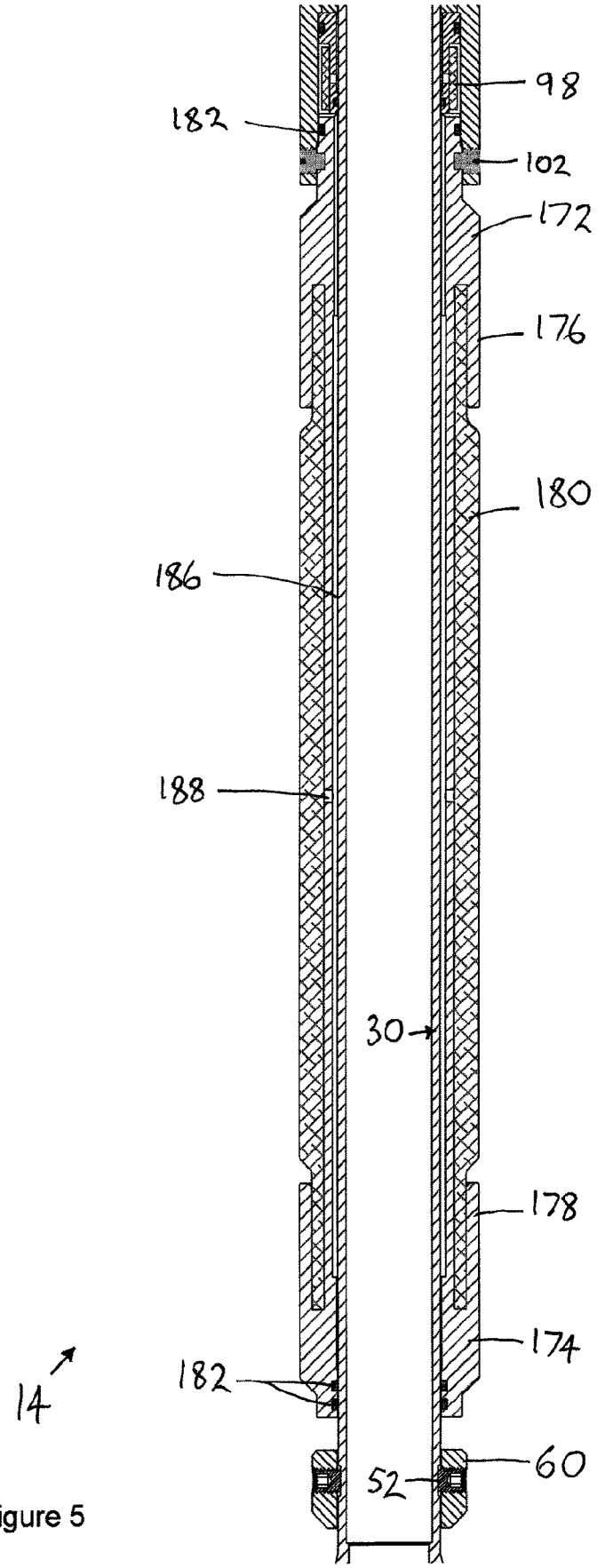
FIG. 5 is a cross-sectional side view of an inflatable packer of the hydraulic anchoring assembly of FIG. 1.

The inflatable packer 14 is of the steel wire reinforced rubber type, such as, for example, as shown in U.S. Pat. No. 5,778,982 (Baski Water Instruments Inc.). As shown in FIGS. 2*a*, 2*b* and FIG. 5 the inflatable packer 14 includes a packer mandrel 170 terminated at its upstream end at a packer top sub 172 and at its downstream end at sliding end sub 174. Each of the subs 172 and 174 has a ferrule 176 and 178, respectively, which retains the ends of a rubber packer element 180. Preferably, the packer element 180 is made from rubber with steel wire reinforcing. The packer top sub 172 is attached to the one-way inflation valve 18 via the shear pins 102 and sealed thereto by O-rings 182. The packer top sub 172 has passageways 184 for communicating inflation fluid from the band check valve 98 to an annular cavity 186 between the inner curved surface of the packer mandrel 170 and the outer curved surface of upper mandrel 30.

Typically, the packer mandrel 170 has packer inflation ports 188 located intermediate its length and extending from the annular cavity 186 to the packer element 180. Well fluids flow passed the band check valve 98 along the passageways 184 into the annular cavity 186 and through the packer inflation ports 188. The packer element 180 is not bonded to the packer mandrel 170 and hence flow of inflation fluid through the packer inflation ports 188 enters into the space between the packer mandrel 170 and the packer element 180. As the inflation fluid continues to flow the packer element 180 expands. The expansion continues until the outer curved surface of the packer element 180 contacts the inner curved surface of the well (or tubular). When pumping of the inflation fluid ceases the pressure of the inflation fluid in the packer element 180 attempts for flow out of the packer element 180 via the one-way inflation valve 18, however, the band check valve 98 prevents the flow the inflation fluid and hence the packer element 180 remains inflated and pressed against the well. This pressure of contact of the packer element 180 to the well achieve sealing of the hydraulic anchoring assembly 10 to the well.

The shear pins 102 can be made to shear by pulling up on the rods with a force of around several tonnes (metric weight). Once the pins 102 shear the pressure of the inflation fluid inside the packer element 180 forces out through the packer inflation port 188, along the annular cavity 186, along the passageways 184 and against the band check valve 98. This force causes the inflatable packer 14 to travel downstream until the sliding end sub 174 lands against the stop collar 60. This travel in the inflatable packer 14 opens the passageways 184 to the well and allows the packer element 180 to deflate, thus releasing the seal against the well, which is needed for extraction of the hydraulic anchoring assembly 10.

Figure 2C:
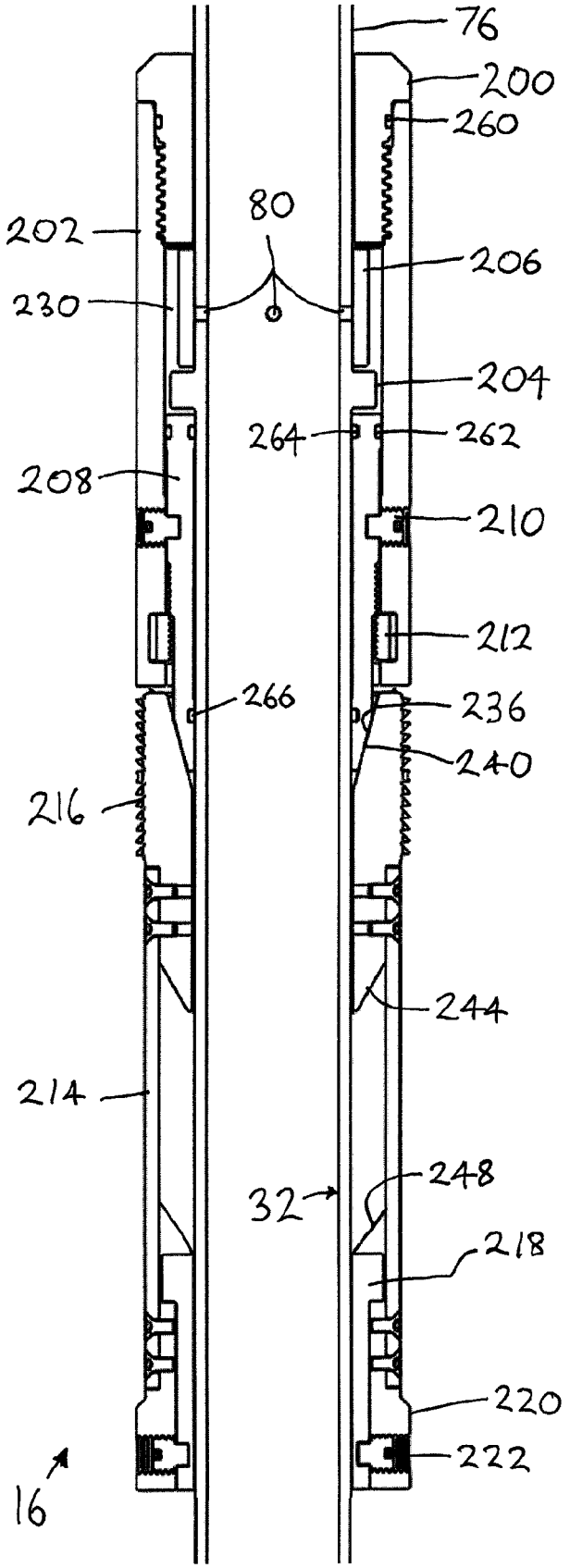
FIG. 2*c* is a cross-sectional side view of a lower portion of the hydraulic anchoring assembly of FIG. 1.
Figure 6A:
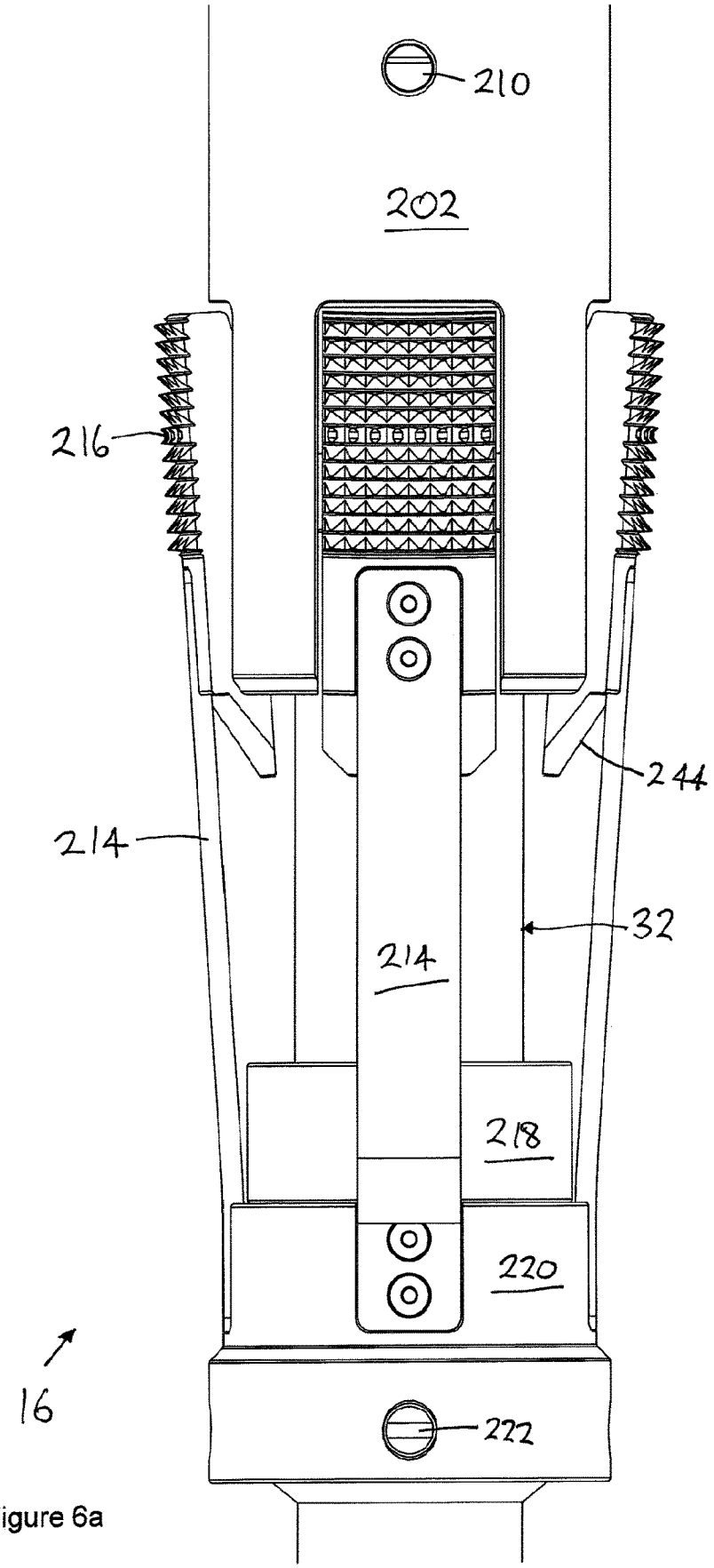
FIG. 6*a* is a side view of a one-way deployment valve and a hydraulic slip of the hydraulic anchor of FIG. 1, shown in the inflation and blow-out mode of operation; and, FIG. 6*b* is a cross-sectional side view of the one-way deployment and hydraulic slip of FIG. 6*a*, shown in the installation model of operation.
Figure 6B:
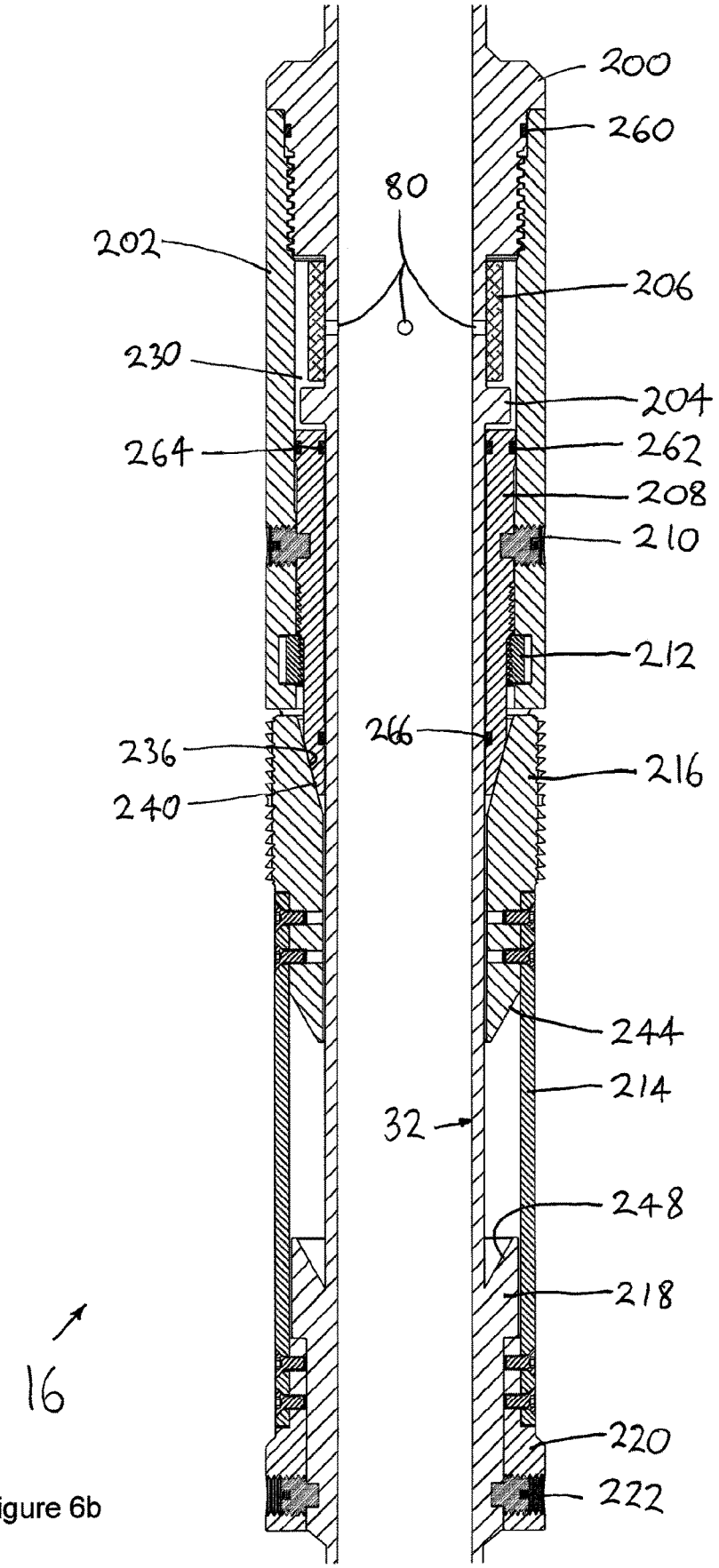

As shown in FIGS. 2*c*, 6*a* and 6*b* the hydraulic slip 16 comprises a top sub 200, a piston housing 202, a band check valve retaining ring 204, a band check valve 206, a piston 208, at least one deployment shear pin 210, a ratchet ring 212, a plurality of pivot arms 214 each with a grab pad 216 at their distal end, a shear out collar 218, a shear sleeve 220 and release shear pins 222.

The top sub 200 is located proximate the lower mandrel cross-over 74. The top sub 200 is not fixed or otherwise attached directly to the lower mandrel 32. The shear out collar 218 is, however, fixed to the lower mandrel 32, typically by welding, and attached to the remainder to the hydraulic slip 16 by the release shear pins 222. Accordingly, the shear out collar 218 and the release shear pins 222 constitute the shear means of the present invention, connecting the hydraulic slip 16 to the inner mandrel 12. When the pins 222 shear the hydraulic slip 16 is no longer attached to the lower mandrel 32 and is free to slide along the lower mandrel 32 towards the lower cross-over 78, as described in more detail hereinafter, which causes the hydraulic slip to release from gripping the well and permit extraction of the I-PCP from the well.

The piston housing 202 is conveniently threadably attached to the top sub 200 and defines a chamber 230 with the lower mandrel 32 within which is located the band check valve 206, the band check valve retaining ring 204, and the piston 208, positioned in that order progressing downstream towards the blow-out plug 22. The piston housing 202 is generally cylindrical and open at its downstream end with the piston 208 disposed to move out of the chamber 230 to engage with the grab pads 216.

The band check valve 206 is similar to the band check valve 98 in its nature, construction and operation, and overlies the ports 80 for control of well fluid flowing from the chamber 230. The band check valve retaining ring 204 holds the band check valve 206 in place over the ports 80 and prevents the band check valve 206 from being washed downstream of the ports 206 by the force of the flow of well fluids into the chamber 230.

The band check valve 206 is designed to allow well fluid to pass from the ports 80 into the chamber 230 for pressures exceeding a predetermined pressure. In the context of the present invention this pressure is referred to as the slip deployment pressure. In the present embodiment the "slip deployment pressure" is typically about 900 psi (about 6.2 MPa).

The piston 208 is generally cylindrical in shape with a inwardly tapering downstream end 236 shaped to bear against an outwardly taping portion of the grab pads 216. The inwardly tapering end 236 acts as a wedge. In the present embodiment the angle of the taper of the end 236 is between about 15 to about 40 degrees to the longitudinal axis of the lower mandrel 32, more particularly between about 20 to 30 degrees, such as, for example, about 25 degrees.

The piston 208 is retained in the piston housing 202 by the shear pins 210 and are set to shear at a predetermined pressure, such as, for example, about 900 psi (about 6.2 MPa). The piston 208 is free to move within the piston housing 202 once the pins 210 shear.

The downstream end of the piston 208 has serrations configured to engage with and be gripped by the ratchet ring 212. The serrations behave as a non-return mechanism to prevent the piston 208 from travelling upstream once it has been forced downstream to wedge between the grab pads 216 and the lower mandrel 32. Accordingly the serrations and the ratchet ring 212 serve to hold the piston 208 in place and prevent release of the grab pads 216 from engaging the well once the hydraulic anchoring assembly 10 has been installed and the pressure of the well fluids reduced to normal pumping pressures. The pressure at which the pins 210 shear is referred to as the "slip deployment pressure" and is greater than the inflate pressure at which the inflatable packer 14 inflates.

Figure 3B:
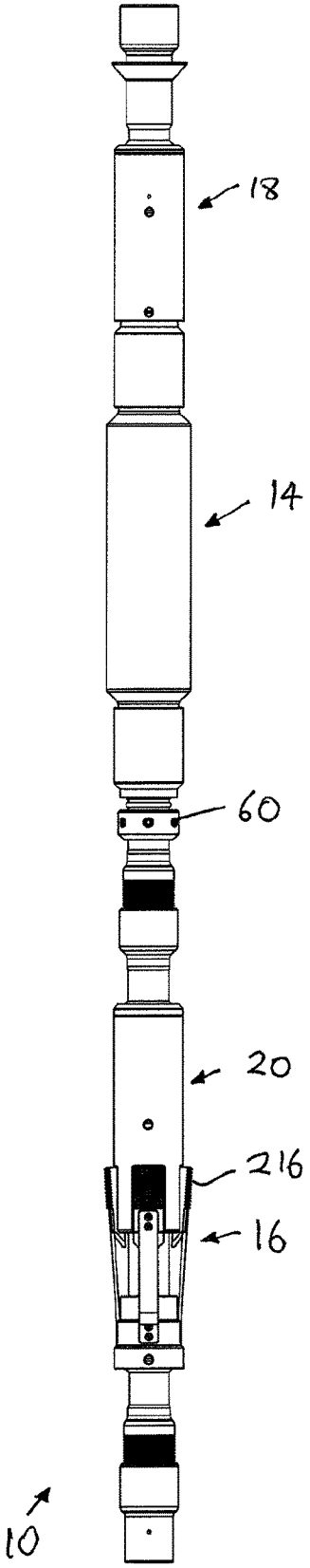
FIG. 3*b* is a side view of the hydraulic anchoring assembly of FIG. 1, shown in an inflation and blow-out mode of operation.
Figure 3C:
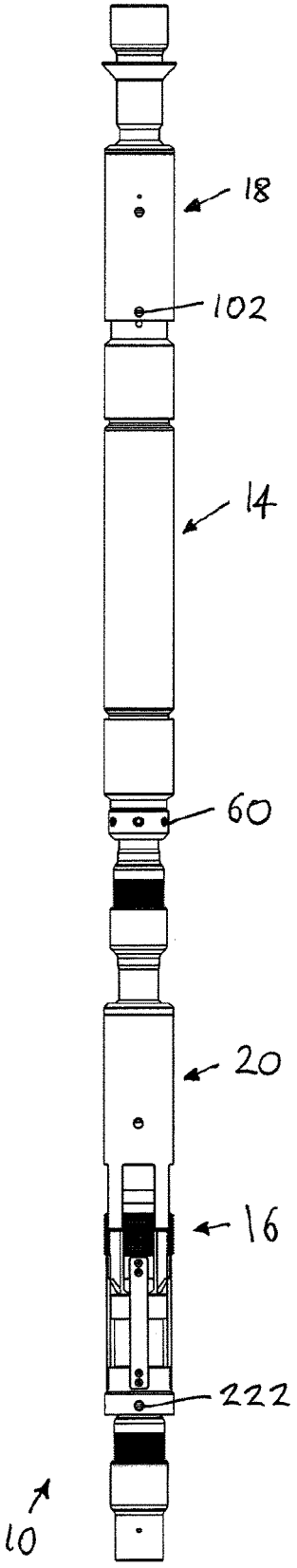
FIG. 3*c* is a side view of the hydraulic anchoring assembly of FIG. 1, shown in deflation and extraction mode of operation.

The arms 214 are typically made from resilient metal material capable be deflecting away from being parallel to the longitudinal axis of the lower mandrel 32 and returning to being parallel to the lower mandrel 32 as shown in FIGS. 3*a* to 3*c*. The arms 214 are fixed at their downstream end to the shear out collar 218. The grab pads 216 are similarly fixed one to each of the arms 214 at their free distal ends adjacent the tapering end 236 of the piston 208. The grad pads 216 have an inner shoulder 204 having a chamfer substantially complementary to the taper of the piston 208, particularly as shown in FIG. 6*b*.

Particularly as shown in FIG. 6*a*, the grab pads 216 each have an external curved surface having texturing 242 for gripping the inner curved surface of the well. The texturing 242 may take many forms including, for example, a pattern of generally triangular pyramidal crests with truncated distal apices in a zigzag arrangement. The pyramidal crests typically have one side that is substantially orthogonal to a base of the grab pad 216 and the other three sides at an acute angle to the base. Typically, groups of the pyramidal crests are arranged in similar arrangements for resisting movement of the hydraulic anchoring assembly 10 from left rotation, right rotation, upstream movement and downstream movement. In this regard the pyramidal crests grip the well and resist movement from the orthogonal side towards the opposite acute side of the pyramidal crest, whilst permitting sliding of the pyramidal crests against movement from the acute side towards the opposite orthogonal side of the pyramidal crests. Accordingly four groups of arrangements of the pyramidal crests are preferred to resist the four movements against which the hydraulic slip 16 is desired to anchor against.

Other forms of texturing 242 are also contemplated. For example, the texturing 242 could be in the form of grit embedded into the surface of the grab pads 216. Alternatively, the texturing 242 could be smooth metal. Further the texturing 242 could include elastomeric material.

The grab pads 216 also have a downstream end 244 that is inwardly tapered at an angle of about 45 degrees.

The shear out collar 218 is generally cylindrical and conveniently welded to the lower mandrel 32 proximate, but spaced from, the lower cross-over 78. The shear out collar 218 has an upstream edge 248 which is chamfered complementary to the taper of the downstream edge 244 of the grab pads 216. The upstream edge 248 of the shear out collar 218 is designed to engage with the downstream edge 244 of the grab pads 216 to force the arms 214 inwardly towards the lower mandrel 32 once the pins 222 have sheared, as described in more detail hereinafter.

The combination of the edge 244 and the edge 248 is conveniently referred to as a "taper lock" and has the effect of disengaging the grab pads 216 from the well and allowing removal of the I-PCP from the well.

O-ring seals 260 to 266 are also provided to ensure the correct operation of the one-way deployment valve 20.

Figure 2D:
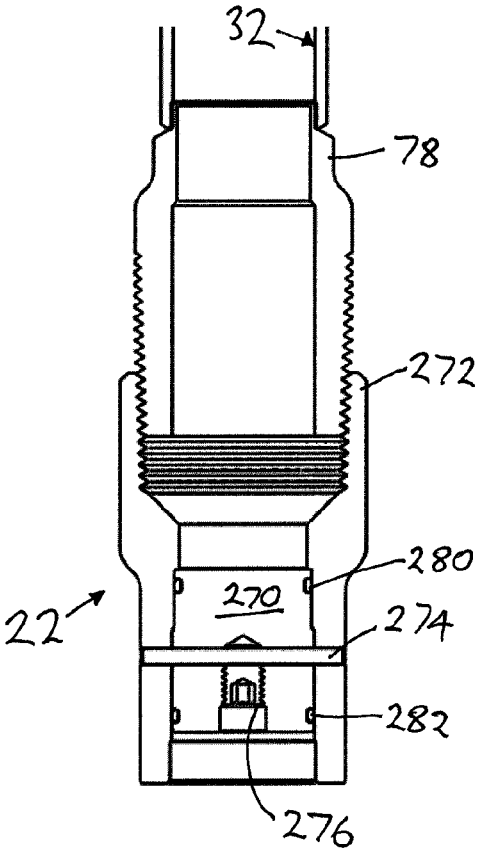
FIG. 2*d* is a cross-sectional side view of a release means of the hydraulic anchoring assembly of FIG. 1.

As shown in FIGS. 1 and 2*d* the release means 22 is conveniently in the form of a blow-out plug 270 held in a shear sub 272 by a blow-out shear pin 274. A grub screw 276 is also conveniently provided to secure the shear pin 274 into the blow-out plug 270. The shear sub 272 is wider at its upstream end than its downstream end so that the blow-out plug 270 can be ejected from the shear sub 272 by the force of pressure of well fluid in the inner mandrel 12. In the present embodiment the release pressure is about 1,100 psi (about 7.6 MPa). The purpose of the release means 22 is to prevent flow of well fluid out of the downstream end of the inner mandrel 12 during installation of the hydraulic anchoring assembly 10, after which the pressure of the well fluid in the inner mandrel 12 can be further increased to shear the pin 274 to release the blow-out plug 270 from the shear sub 272 to allow well fluid to be pumped to the surface of the well by the I-PCP. The blow-out plug 270 also has O-ring seals 280 and 282 to ensuring sealing of the inner mandrel 12 during installation of the hydraulic anchoring assembly 10.

Typically, the blow-out plug 270 is made from dissolvable material so as to not foul the downstream end of the well or be sucked back up into or proximate the shear sub by the pumping action of the I-PCP. Typically the dissolvable blowout plug 270 is a metal which dissolves by galvanic reaction with water in the well.

Alternatively, the release means 22 could have a shear sub which is wider at its upstream end than its downstream end for retaining a dissolvable metals material ball capable of dissolving, such as, for example, by galvanic reaction with water in the well.

Typically, the galvanic reactions take 12 to 24 hours to completely dissolve the blow-out plug 270 or ball, depending upon the temperature of the environment around the hydraulic anchoring assembly 10.

Typically the majority of the components of the hydraulic anchoring assembly 10 are made of metals materials, except for the bands 98 and 206 and the O-ring seals. More typically the metal materials components are made from stainless steel or packetized mild steel, except the blow-out plug 270 which is made from water dissolvable metals materials.

Use

In use, the top cross over 40 of the hydraulic anchoring assembly 10 is attached to the stator of an I-PCP and then run into a well using sucker rods. The I-PCP is lowered to its desired depth of operation for pumping production fluids to the well surface. Typically the depth of operation is between 100 metres and 2,000 metres, although other depths of operation are likely possible.

The purpose of the hydraulic anchoring assembly 10 is to anchor the I-PCP to the well at the desired depth so as to inhibit rotation and longitudinal movement of the stator of the I-PCP during pumping of production fluids. The hydraulic anchoring assembly 10 is installed in this manner for the entire duration of the operation of the I-PCP.

The hydraulic anchoring assembly 10 and the I-PCP can be run into the well either by pushing on the end of sucker rods or by being pumped down using pressured well fluids forcing against the cup seal 42. The latter is preferred in situations where either the depth of deviation of the well is such that insufficient force can be applied to the I-PCP via the sucker rods.

During run in the pressure of well fluids in the inner mandrel 12 is resisted by the one-way inflation valve 18 so as to avoid premature inflation of the inflatable packer 14. In the event that the sucker rods alone are used to push the I-PCP into its operational position the premature inflation sleeve 94 and the inflation shear pins 100 are not required. In such case the band check valve 98 resists the well fluid pressure during run in.

Once at depth, the pressure of the well fluids is increased to bypass the band check valve 98, flow into the inflation chamber 108, through the passageway 184 and into the inflatable packer 14. Inflation fluids flow from the passageway 184 through the packer inflation port 188 and into the packer element 180 causing the element 180 to inflate until it contacts the well. Inflation fluids continue to be pumped into the inflatable packer 14 until the desired sealing pressure is achieved. Typically, this sealing pressure is above about 700 psi (about 4.8 MPa).

Where the I-PCP is pumped down the well the fluid pressure in the inner mandrel 12 is increased until the pins 100 shear causing the premature inflation sleeve 94 to travel upstream in to close off the annular exhaust cavity 120 and expose the inflation ports 50 to the band check valve 98. Once the pressure rating of the band check valve 98 is exceeded the inflation fluid flows into the inflation chamber 108, along the passageways 184, through the packer inflation ports 188 and into the packer element 180 which then inflates until it contacts the well.

Once the packer 14 is inflated the pressure in the packer 14 is retained by the operation of the one-way inflation valve 18. In particular, the band check valve 98 inhibits flow of inflation fluid from the inflation chamber 108 through the inflation port 132 and into the inner mandrel 12 via the ports 50. Accordingly the I-PCP is sealed to the well by the operation of the inflatable packer 14.

Whilst the inflatable packer 14 can provide some grip against the well and resist some torsional and translations force exerted by the I-PCP this places undue stress on the inflatable packer 14 and reduces it operational life. Accordingly the hydraulic slip 16 is provided to grip the well and restrain the I-PCP for movement relative to the well during the life of operation of the I-PCP.

Further increase of the well pressure, by use of a pump at the surface of the well (in known manner), bypasses the one-way deployment valve 20 to cause the pins 210 to shear, and the piston 208 to travel downstream towards the blow-out plug 270. The travel of the piston 208 forces the serrations passed the ratchet 212 and drive the arms 214 outwardly for the grab pads 216 to grip the well. More particularly, the increased well pressure forces passed the band check valve 206 via the ports 80 from the inner mandrel 12 and enters the chamber 230. When the pressure exceeds about, for example, 900 psi (about 6.2 MPa) the pins 210 shear, forcing the piston 208 in the downstream direction so that the end 236 engages with the grab pads 214 to wedge them outwardly and grip the well. Typically, a force of around 7 metric tonnes is imparted to grip the well in this manner. Movement of the arms 216 and the grab pads 214 to engage the well is shown in FIG. 3*b*. In this mode the ratchet engages with the serrations of the piston 208 and prevent the piston 208 from moving upstream and accordingly latch the hydraulic slip 16 into engagement with the well to anchor the I-PCP into the well.

Once the grab pads 214 are engaged with the well further increase in pressure of the well fluids causes the pin 274 to shear and to release the blow-out plug 270 from the shear sub 272 for allowing production fluids to flow through the hydraulic anchoring assembly 10 to the I-PCP. So as to avoid the blow-out plug 270 inhibiting the flow of production fluids it is preferred that the plug 270 dissolve. Typically this is achieved by exposure to water in the well which dissolves the plug 270 by galvanic reaction which takes between about 12 and 24 hours depending upon the temperature of the well.

When it is desired to remove the I-PCP from the well the hydraulic anchoring assembly 10 can be reset by pulling up on the sucker rods with a force of several tonnes. This shears the deflation pins 102 which uncouples the inflatable packer 14 from the one-way inflation valve 18 allowing the pressurised inflation fluid in the packer element 180 to be released. This causes the inflatable packer 14 to deflate and cease to seal against the well. Further pull up on the sucker rods causes the pins 222 to shear allowing the I-PCP and the inner mandrel 12 to begin to move upstream in the well. At this point the grab pads 216 are likely stuck fast to the well. The upstream movement of the inner mandrel 12 causes the shoulder 248 of the shear out collar 218 to engage with the inwardly tapered shoulder 244 of the grab pads 216 and force them towards the lower mandrel 32, thus disengaging the grab pads 214 from the well and hence the hydraulic slip 16. Further pulling on the sucker rods permits the I-PCP and the hydraulic anchoring assembly 10 to be removed from the well. The status of the hydraulic anchoring assembly during retrieval of the I-PCP is shown in FIG. 3*c*. In this mode the shear pins 102 and 222 have sheared.

Critical to the operation of the hydraulic anchoring assembly 10 of the present invention is that there is no movement of the inner mandrel 12 with respect to the inflatable packer 14 (seal packer) and also no movement of the inner mandrel 12 with respect to the hydraulic slip 16, whilst in the installation and blow-out mode of operation shown in FIG. 3*b*.

Second Embodiment

The main differences between the second embodiment 10*a* and the first embodiment 10 is that there are two or more cups seals 42 and two or more inflatable packers 14 and 14*a*. The reason for the second cup seal 42 is to improve the pressure differential experienced by the upstream inflatable packer 14 to improve its chances of inflating. The reason for the second inflatable packer 14*a* (located downstream of the first inflatable packer 14) is to guarantee a seal between an I-PCP (not shown) and production tubing is achieved even where the upstream inflatable packer 14 does not achieve full inflation.

Figure 7A:
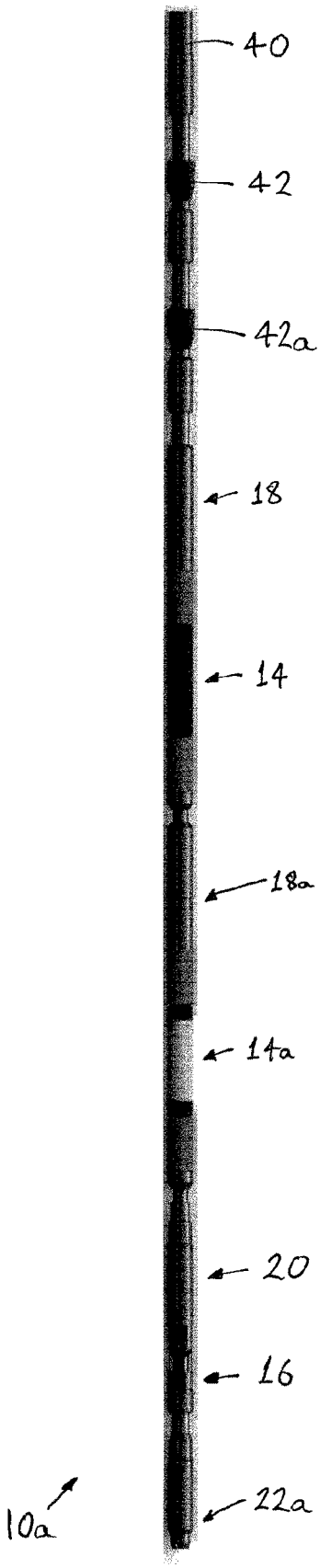
FIGS. 7*a* to 7*c* are respectively a pictorial side view, a line side view and a cross-sectional side view of a hydraulic anchoring assembly for an I-PCP in accordance with another embodiment of the present invention.
Figure 7B:
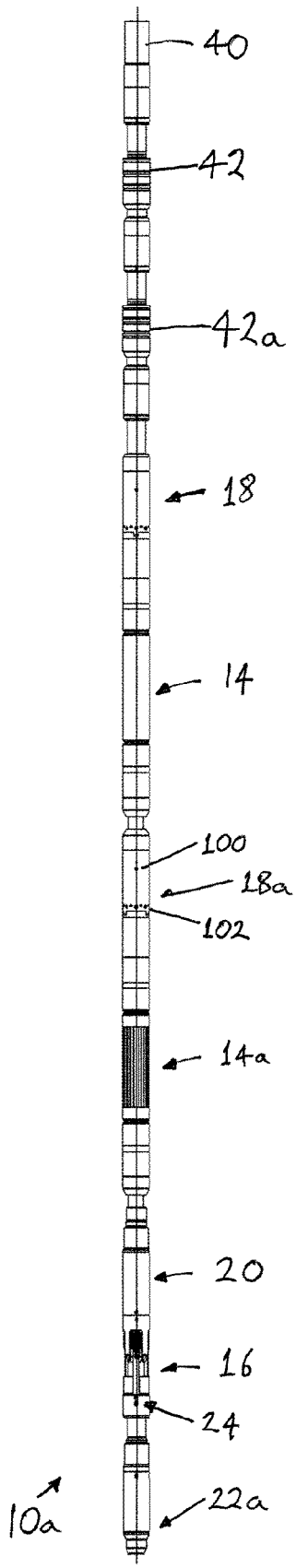
Figure 7C:
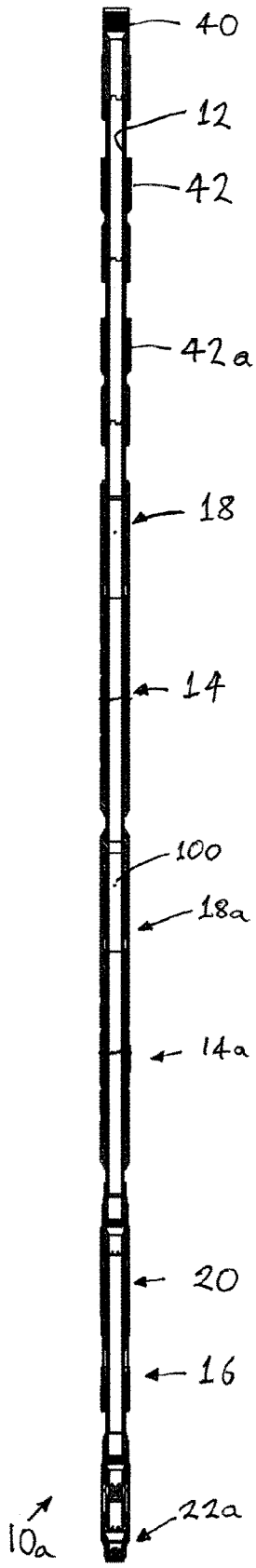
Figures 8A, 8B, 8C, 8D, 8E:
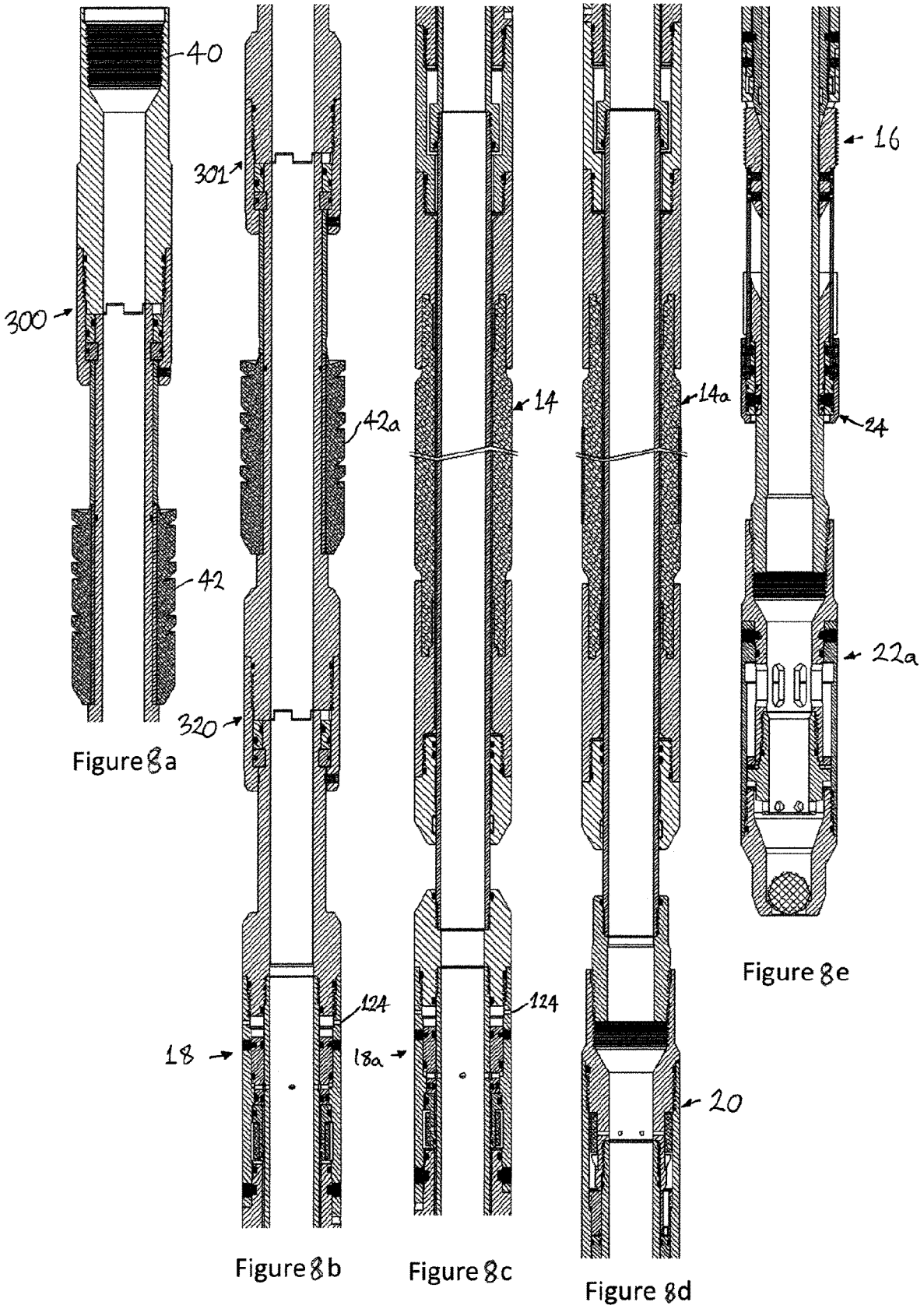
FIGS. 8*a* to 8*e* are cross-sectional side views of consecutive segments of the hydraulic anchoring assembly of FIGS. 7*a* to 7*c*, to a larger scale.

As shown in FIGS. 7*a* to 7*c* the hydraulic anchoring assembly 10*a* of the present embodiment comprises an inner mandrel 12, an upstream inflatable packer 14, a downstream inflatable packer 14*a* and a hydraulic slip 16 both set upon the inner mandrel 12. The anchoring assembly 10*a* also comprises a one-way valve 18 in fluidic communication with the inflatable packer 14, another one-way valve 18*a* in fluidic communication with the inflatable packer 14*a*, a one-way deployment valve 20 in fluidic communication with the hydraulic slip 16, a well sealing means 22, and a release means 24 for deflating the inflatable packers 14 and 14*a* and for releasing the hydraulic slip 16. The hydraulic anchoring assembly 10*a* is intended for deployment with an I-PCP (exemplified by U.S. Pat. No. 7,905,294) in a well (not shown) for pumping well fluids out of the well to the surface of the well.

The I-PCP has a rotor and a stator (not shown). The rotor is attached to and driven by sucker rods (not shown) and the stator is attached to the inner mandrel 12 at the upstream end of the hydraulic anchoring assembly 10*a*. Prior to deployment the stator of the I-PCP is attached to the inner mandrel 12 of the hydraulic anchoring assembly 10*a* and the pair are run into the well with the sucker rods, typically inside the casing of the well or other tubulars within the casing.

Figure 9A:
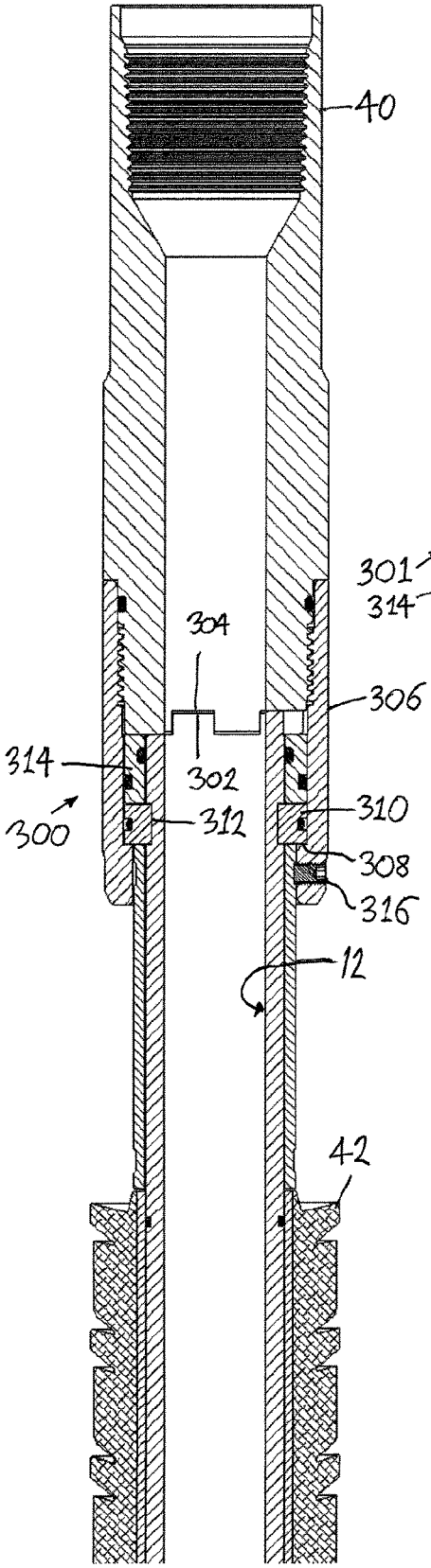
FIGS. 9*a* to 9*i* are cross-sectional side views consecutive segments of the hydraulic anchoring assembly of FIGS. 7*a* to 7*c*, to a still larger scale.
Figure 9B:
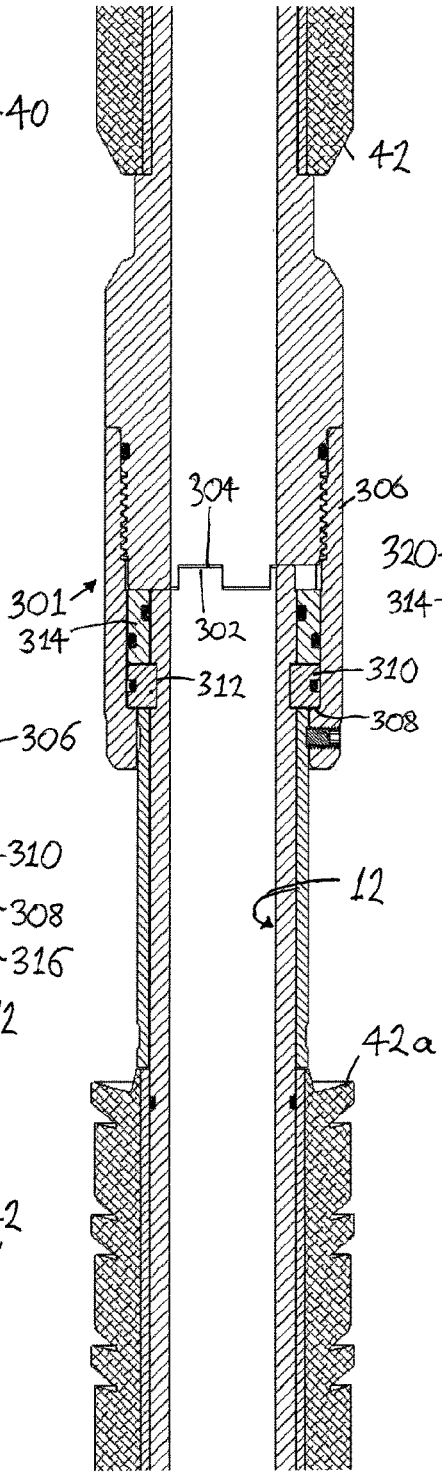

As shown in FIGS. 9*a* and 9*b*, the cup seals 42 and 42*a* are each provided with an anti-rotation coupling 300 and 301, respectively, at their upstream end. The couplings 300 and 301 each has castellations 302 mating with corresponding castellations 304 located in the corresponding upstream portion of the hydraulic anchoring assembly 10*a*. Each coupling 300 and 301 has a coupling nut 306 which threadedly engages with a threaded upstream portion of the hydraulic anchoring assembly 10*a*. A downstream end of the coupling nut 306 has a shoulder 308 which bears against a split locking ring 310 located in an annular groove 312 located on the external curved surface of the upper mandrel 30. Conveniently a seal ring 314 is provided between the split lock ring 310 and the upstream end of the coupling 300 to seal the coupling to the upper mandrel 30. A grub screw 316 is provided to inhibit accidental rotation and loosening of the coupling nut 306 during use.

Figure 9C:
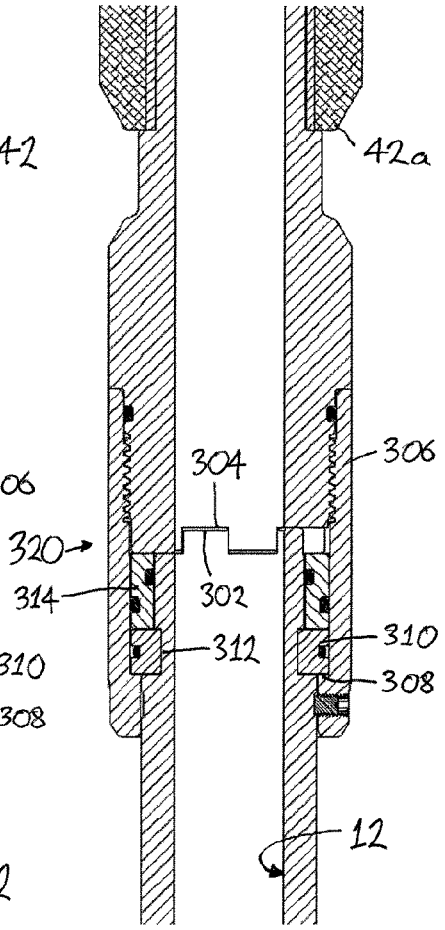
Figures 9D, 9E, 9F:
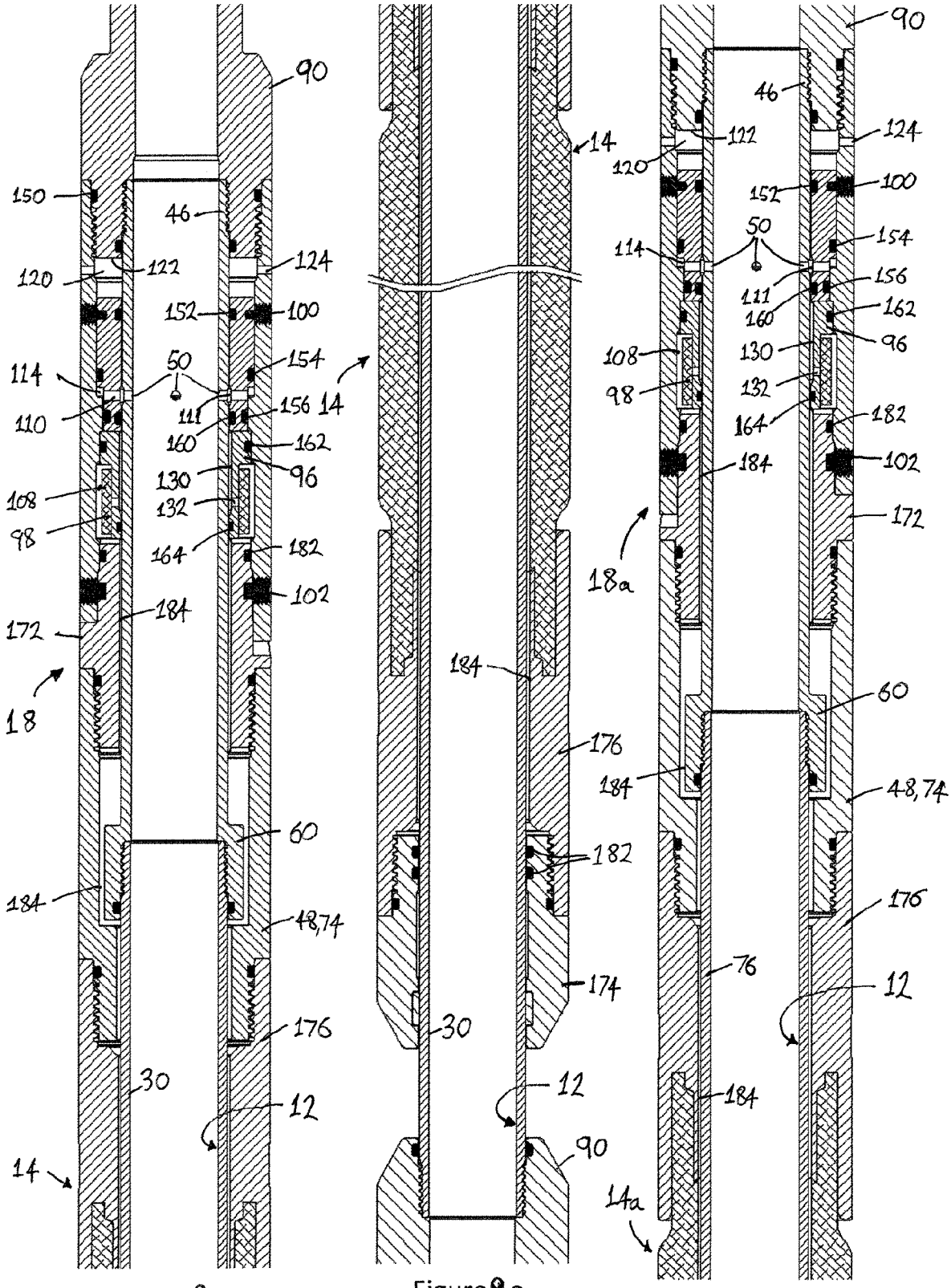
Figure 9G:
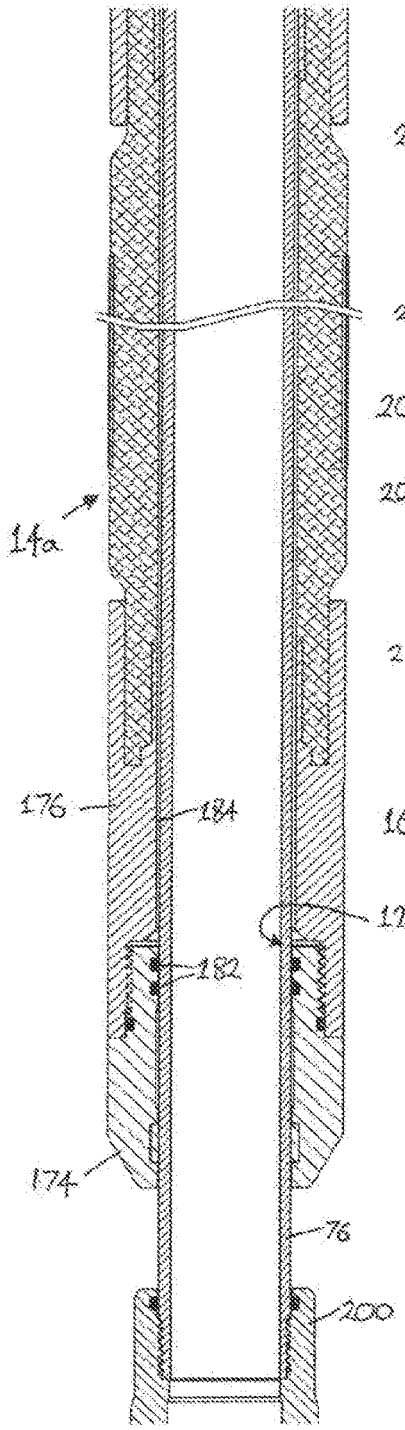
Figure 9H:
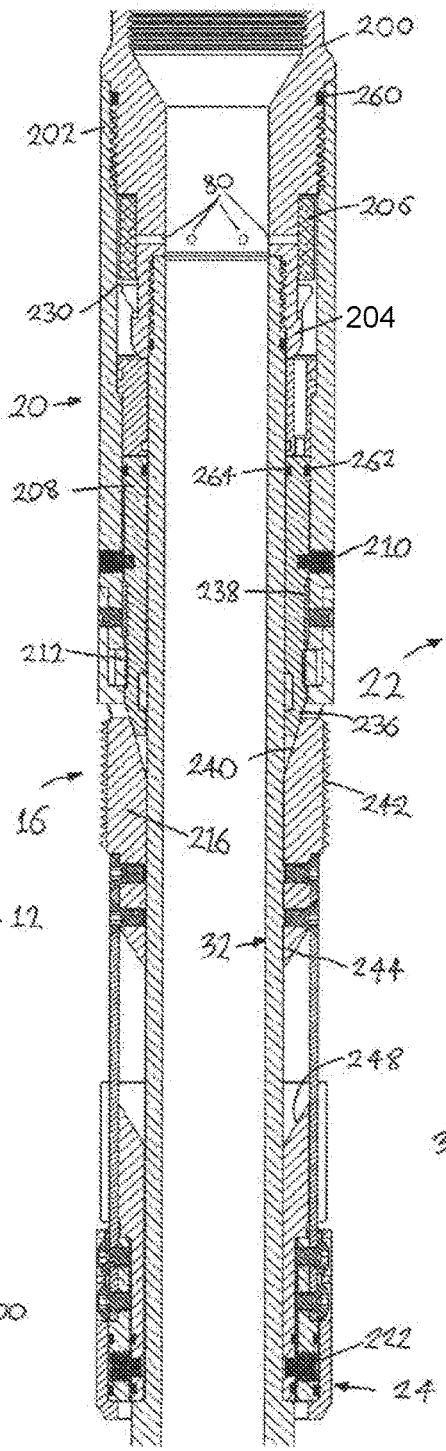
Figure 9I:
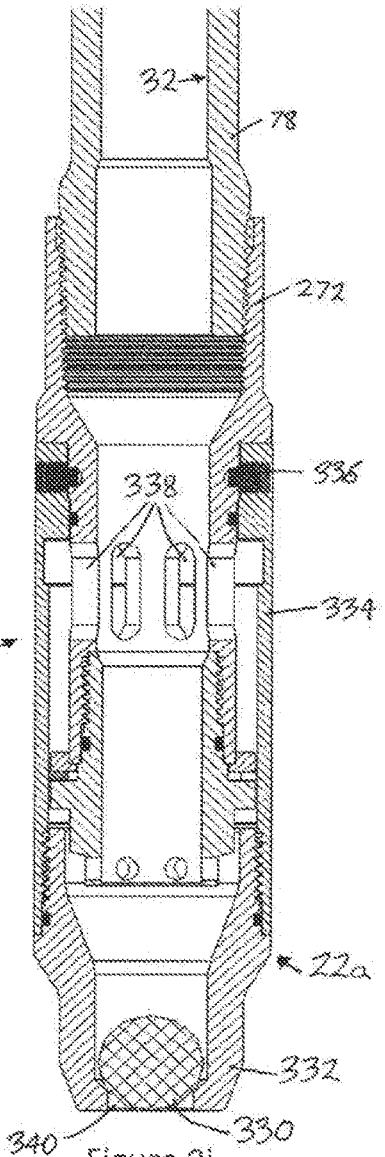

A further anti-rotation coupling 320 is provided below the downstream cup seal 42*a* (see FIG. 9*c*). The coupling 320 is typically the same as the couplings 300 and 301 and like numerals denote like parts.

The effect of the couplings 300, 301 and 320 is that unthreading above and below the cup seals 42 and 42*a* is inhibited. Unthreading can be caused where the cup seals 42 and 42*a* create drag in the well tubulars and the sucker rod string is stroked up and down.

Typically, anti-rotation couplings are not needed at the inflatable packers 14 and 14*a* or the hydraulic slip 16, since these components do not have a drag on the well tubulars during run-in of the hydraulic anchoring assembly 10*a* of the present embodiment.

A one way valve 18 and 18*a* is located upstream of each of the inflatable packers 14 and 14*a* respectively, and like numerals denote like parts.

The downstream end of the hydraulic anchoring assembly 10*a* has a sealing means 22*a* in the form of a dissolvable ball 330, located in a ball seat 332. The sealing means 22*a* also has a shear sleeve 334 slidable by the shearing of shear pins 336 to reveal ports 338 for communication of well fluids from downstream of the well into the hydraulic anchoring means 10*a* and there through to the I-PCP and thence out of the well. An orifice 340 is left at the end of the sealing means 22*a* once the ball 330 has dissolved to allow greater flow through the hydraulic anchoring assembly 10*a* and to inhibit material blocking up the sealing means 22*a* once opened.

The inner mandrel 12 is connected downstream of the I-PCP. The inflatable packers 14 and 14*a* are connected to the inner mandrel 12 by shearable means (conveniently in the form of shear pins) located in the one-way valves 18 and 18*a* respectively, the inflatable packers 14 and 14*a* being inflated by increasing pressure of fluids within the inner mandrel 12 above a predetermined pressure, in the context of the present invention referred to as the "inflate pressure" to seal the inner mandrel 12 (and hence the I-PCP) to the well. The inflate pressure is the pressure required to overcome the one-way valves 18 and 18*a* and cause the inflatable packers 14 and 14*a* respectively to inflate. The one-way valves 18 and 18*a* are in fluidic communication with their respective inflatable packers 14 and 14*a* to maintain inflation of the inflatable packers 14 and 14*a*. The hydraulic slip 16 is connected to the inner mandrel 12 by shearable means (conveniently in the form of shear pins), the hydraulic slip 16 is activated by further increasing pressure of fluids within the inner mandrel 12 above a slip deployment pressure for gripping the well to resist longitudinal and rotational movement of the inner mandrel 12 (and hence the stator of the I-PCP) in the well. The other one-way valve 20 is in fluidic communication with the hydraulic slip 16 to maintain grip of the inflatable slip 16 within the well. The well sealing means 22, conveniently in the form of a dissolvable ball, seals the inner mandrel 12 downstream of the hydraulic slip 16 to prevent flow of well fluid through the inner mandrel 12 during run-in of the hydraulic anchoring assembly 10*a*. The sealing means 22 permits inflation of the inflatable packer 14 for pressures above the inflate pressure, and further increases in pressure of the well fluid in the inner mandrel 12 cause the hydraulic slip 16 to deploy and engage with and "grab" the well. In the context of the present invention this pressure is referred to as the "slip deployment pressure". The slip deployment pressure is the pressure required to overcome the one-way valve 20 cause the hydraulic slip 16 to deploy and grip the well. The hydraulic anchoring assembly 10*a* remains in this mode of operation for most of its operational life and the I-PCP stator is held stationary with respect to the well so the rotor can operate to pump well fluid to the surface of the well. The release means 24, conveniently in the form of shear pins, releases pressure from and deflates the inflatable packer 14 and releases the hydraulic slip 16 for releasing the hydraulic anchoring assembly 10*a* for disengagement from the well when it is desired to remove the I-PCP from the well.

More particularly, as shown in FIGS. 9*a* to 9*i*, the hydraulic anchoring assembly 10*a* comprises the top crossover 40, followed by the anti-rotation coupling 300, the cup seal 42, the anti-rotation coupling 301, the second cup seal 42*a*, the anti-rotation coupling 320, the one-way valve 18, the inflatable packer 14, the second one-way valve 18*a*, the second inflatable packer 14*a*, the one-way deployment valve 20, the hydraulic slip 16, the release means 24 and the sealing means 22. These are described in detail in relation to the first embodiment hereinabove.

There are some minor differences between the drawings depicting these components in the second embodiment. For example, the design has been altered to obviate the need for welding components together. The stop collar 60 has been moved from outside the mandrel 30 to within the lower crossover 48, in which case grub screws are not needed. Also, the second lower crossover 48 and the lower mandrel crossover 74 are one and the same in the second embodiment.

Use

In use, the top cross over 40 of the hydraulic anchoring assembly 10*a* is attached to the stator of an I-PCP and then run into a well using sucker rods. However, where the force needed to drive the I-PCP to its desired position is too high (resulting in buckling of the sucker rods) well fluids can be used to pump the hydraulic anchoring assembly 10*a* down the well—thus assisting the sucker string in its task of delivery of the I-PCP.

Operation of the hydraulic anchoring assembly 10*a* is generally as described in relation to the first embodiment for hydraulic anchoring assembly 10.

The main difference in the operation of the second embodiment is that the downstream inflatable packer 14*a* is guaranteed to fully inflate by the at least partial inflation of the upstream inflatable packer 14, since the upstream inflatable packer 14 is capable of providing sufficient pressure differential to achieve full inflation of the downstream inflatable packer 14*a*, whereas the cup seals 42 and 42*a* may not be able to achieve adequate pressure differential—especially in out of round tubulars, or where the cup seals 42 and 42*a* become damaged during insertion of the I-PCP to its operational location in the well.

The other operational difference is in the use of the dissolving ball 330 for the sealing means 22*a* in place of the blow-out plug 270 of the first embodiment.

INDUSTRIAL APPLICABILITY

The hydraulic anchoring assembly 10, 10*a* of the present invention is suitable for anchoring I-PCP's into wells for permitting pumping of production fluids to the surface of the well.

The hydraulic anchoring assembly 10, 10*a* of the present invention resides and operates in the fields of wells used to extract production fluids from depth.

The consequence of the use of the hydraulic anchoring system 10, 10*a* of the present invention is that an I-PCP can be installed in a well without the need for a PSN. Also, the !-PCP can be securely held at its desired depth and sealed into the well to improve the efficiency of pumping production fluids to the surface of the well, compared with conventional mechanical packers and mechanical slips.

Further, the hydraulic anchoring assembly 10, 10*a* permits hydraulic pump down assistance of the I-PCP via the cup seals 42, 42*a*, to achieve deployment in situations where sucker rods alone would normally buckle.

REFERENCE SIGNS

The specification uses the following reference signs:

10, 10*a* hydraulic anchoring assembly
12 inner mandrel
14, 14*a* inflatable packer
16 hydraulic slip
18, 18*a* one-way valve
20 one-way deployment valve
22, 22*a* well sealing means
24 release means
30 upper mandrel
32 lower mandrel

40 top cross-over
42, 42*a* cup seal
44 upper mandrel cross-over
46 upper mandrel pipe
48 lower cross-over
50 ports
52 annular groove
60 stop collar
62 grub screw
74 lower mandrel cross-over
76 lower mandrel pipe
78 lower cross-over
80 ports
90 top sub
92 inflation housing
94 premature inflation sleeve
96 band check valve seat
98 band check valve
100 inflation shear pin
102 shear pins
108 inflation chamber
110 inflation port
111 annular groove
112 shoulder
114 shoulder
120 annular exhaust cavity
122 downstream shoulder
123 upstream end
124 exhaust port
130 passageways
132 inflation ports
150-164 O-ring seals
170 packer mandrel
172 packer top sub
174 sliding end sub
176 ferrule
178 ferrule
180 packer element
182 O-ring
184 passageways
186 annular cavity
188 packer inflation port
200 top sub
202 piston housing
204 band check valve retaining ring
206 band check valve
208 piston
210 deployment shear pin
212 ratchet ring
214 pivot arm
216 grab pad
218 shear out collar
220 shear sleeve
222 release shear pin
230 chamber
236 inwardly tapering downstream end
238 serrations
240 inner shoulder
242 texturing
244 downstream end
248 upstream edge
260-266 O-ring seals
270 blow-out plug
272 shear sub
274 blow-out shear pin
276 grub screw
280 O-ring seal
282 O-ring seal
300, 301 anti-rotation coupling
302 castellations downstream
304 castellations upstream
306 coupling nut
308 shoulder
310 split lock ring
312 annular groove
314 seal ring
316 grub screw
320 anti-rotation coupling
330 dissolvable ball
332 ball seat
334 shear sleeve
336 shear pins
338 ports
340 orifice

Advantages

The hydraulic anchoring assembly 10, 10*a* of the present invention has the advantage that it is better suited to anchoring an insert PCP into a well than conventional anchors. This improvement is achieved by the use of the inflatable packers 14 and 14*a* and the hydraulic slip 16-which can be activated without having to pull or push sucker rods.

Also, the inflatable packers 14 and 14*a* provide an improved seal for the I-PCP with the well since the inflatable packers 14 and 14*a* have a greater expansion ratio and are more compliant than mechanical packers conventionally used for anchors.

Further, the hydraulic slip 16 provides improved gripping of the well than mechanical slips conventionally used for anchors.

Still further, the hydraulic anchoring assembly 10, 10*a* provides anchoring and sealing for an I-PCP without the need for a pump seating nipple (PSN). Consequently the limitations of PSN's are avoided. Most particularly, the hydraulic anchoring assembly 10, 10*a* has the advantage that it can seal the I-PCP at almost any desired position in the well, thus avoiding the need for predetermining where future pump landing zones may be needed.

Still further, the cup seals 42 and 42*a* and the one-way valves 18 and 18*a* permit the I-PCP and the hydraulic anchoring assembly 10, 10*a* to be pumped down the well, which overcomes the limitation of buckling of sucker rods in deep and highly deviated wells, which is a common problem of conventional I-PCP deployment and anchoring.

Still further, the cup seal 42 (and 42*a*) provides, in many cases, sufficient pressure differential to enable full inflation of the inflatable packer 14 (and 14*a*).

Still further, in situations where the cup seals 42 and 42*a* provide inadequate pressure differential for full inflation of the upstream inflatable packer 14, full inflation of the downstream inflatable packer 14*a* is ensured by the pressure differential achieved across the partially inflated upstream inflatable packer 14.

MODIFICATIONS AND VARIATIONS

It will be readily apparent to persons skilled in the relevant arts that various modifications and improvements may be made to the foregoing embodiments, in addition to those already described, without departing from the basic inventive concepts of the present invention. For example, the inner mandrel 12 could be formed with the upper mandrel 30 and the lower mandrel 32 as a single pipe. Also, whilst the packer element 180 is described as rubber it could alternatively be made from other elastomeric materials, such as, for example, synthetic rubber, including Nitrile rubber. Other dissolvable materials could be used for the blow-out plug 270 or ball. Also other forms of arms 216 may be used for deploying the grab pads 214, for example, a scissor action type arm may be used to increase the distance the grab pads 214 move without producing an angle of offset between the face of the grab pads 214 and the inner curved surface of the well. Still further, other forms of sealing means 22 could be used.

The invention claimed is:

1. A hydraulic anchoring assembly for anchoring and sealing an insertable progressing cavity pump delivered on rods in a well, the progressing cavity pump having a stator and a rotor, the stator being attached to the well and the rotor being connected to the rods, the anchoring assembly comprising:

an inner mandrel having a longitudinal bore therethrough, the inner mandrel being connected to a downstream end of the stator, the inner mandrel being in fluidic communication with the insertable progressing cavity pump;

an inflatable packer connected to the inner mandrel by shearable means, the inflatable packer being inflated by increasing pressure of fluids within the bore of the inner mandrel above an inflate pressure to seal the inner mandrel to the well;

a one-way inflation valve in fluidic communication with the inflatable packer to maintain inflation of the inflatable packer;

a hydraulic slip means connected to the inner mandrel by shearable means, the hydraulic slip being located downstream of the inflatable packer and activated by further increasing pressure of fluids within the bore of the inner mandrel above a slip deployment pressure for gripping the well to resist longitudinal and rotational movement of the inner mandrel with respect to the well;

a one-way deployment valve located between the inflatable packer and the hydraulic slip means, the one-way deployment valve being in fluidic communication with the hydraulic slip means to maintain deployment of the hydraulic slip means; and a sealing means for sealing off the bore of the inner mandrel downstream of the hydraulic slip means for preventing flow of fluid through the bore of the inner mandrel whilst the insertable progressing cavity pump is deployed into the well, the sealing means being releasable to allow fluid to flow upstream through the bore of the inner mandrel to the insertable progressing cavity pump when in operation;

wherein the inflate pressure is below the slip deployment pressure; and wherein actuation of the inflatable packer and the hydraulic slip means are triggered by changes in the pressure of the fluid within the bore of the inner mandrel.

2. The hydraulic anchoring assembly according to claim 1, also comprising a restriction means located upstream of the inflatable packer to provide a pressure differential for facilitating inflation of the inflatable packer.

3. The hydraulic anchoring assembly according to claim 2, in which the restriction is one or more cup seals.

4. The hydraulic anchoring assembly according to claim 2, also comprising an anti-rotation coupling disposed between the restriction means and the inflatable packer for inhibiting rotation of the inflatable packer with respect to the insertable progressing cavity pump.

5. The hydraulic anchoring assembly according to claim 1, comprising two or more inflatable packers, whereby the pressure differential across an upstream one of the inflatable packers provides for full inflation of a downstream one of the inflatable packers.

6. The hydraulic anchoring assembly according to claim 1, comprising two or more hydraulic slip means disposed downstream of the inflatable packer.

7. The hydraulic anchoring assembly according to claim 1, also comprising a premature inflation sleeve to prevent inflation of the inflatable packer during run in.

8. The hydraulic anchoring assembly according to claim 1, also comprising a release means for releasing pressure from and deflating the inflatable packer and releasing the hydraulic slip means for releasing the anchoring assembly from engagement with the well.

9. The hydraulic anchoring assembly according to claim 1, also comprising a shearable means in operative association with the inflatable packer such that pull up on the rods deflates the inflatable packer and another shearable means in operative association with the hydraulic slip means such that further pull up on the rods releases the hydraulic slip means and allows the anchoring assembly to be removed from the well.

10. The hydraulic anchoring assembly according to claim 1, also comprising an anti-rotation coupling disposed between the inner mandrel and the insertable progressing cavity pump.

11. The hydraulic anchoring assembly according to claim 10, in which the anti-rotation coupling comprises castellations for preventing rotation of the inner mandrel with respect to the insertable progressing cavity pump.

12. A method for anchoring and sealing an insertable progressing cavity pump having a stator and a rotor, the insertable progressing cavity pump being delivered on rods in a well with a hydraulic anchoring assembly for anchoring and sealing the insertable progressing cavity pump in the well, the hydraulic anchoring assembly comprising an inflatable packer disposed upon an inner mandrel having a longitudinal bore therethrough, and with a hydraulic slip means located downstream of the inflatable packer, the method including the steps of:

connecting the inner mandrel of the hydraulic anchoring assembly to the downstream end of the stator of the insertable progressing cavity pump;

running the hydraulic anchoring assembly into the well to a location where the insertable progressing cavity pump is to be operated;

increasing the pressure of fluids in the bore of the inner mandrel above a first pressure to inflate the inflatable packer to seal the insertable progressing cavity pump to the well;

further increasing the pressure of fluids in the bore of the inner mandrel above a second pressure to activate the hydraulic slip means for gripping the well to resist longitudinal and rotational movement of the insertable progressing cavity pump in the well; and releasing a sealing means for allowing fluid to flow upstream through the bore of the inner mandrel to the insertable progressing cavity pump;

wherein the first pressure is below the second pressure; and wherein actuation of the inflatable packer and the hydraulic slip means are triggered by changes in the pressure of the fluid within the inner mandrel.

13. The method according to claim 12, also including a step of run-in installation of the hydraulic anchoring assembly via a run-in fluid pressure above a restriction means located upstream of the inflatable packer, and hydraulically forcing the hydraulic anchoring assembly with the restriction means down the well, the run-in pressure being less than the first inflate pressure.

14. The method according to claim 13, also including the step of releasing a sealing means located downstream of the hydraulic slip means by increasing the pressure of fluids in the bore of the inner mandrel above a third pressure, the third pressure being greater than the second pressure.

15. The method according to claim 12, also including the step of pulling up on the rods to deflate the inflatable packer, and further pulling up on the rods to release the hydraulic slip means to allow the anchoring assembly to be removed from the well.

* * * * *